US010208695B2

(12) United States Patent
Yamashita et al.

(10) Patent No.: US 10,208,695 B2
(45) Date of Patent: Feb. 19, 2019

(54) CONTROL APPARATUS OF INTERNAL COMBUSTION ENGINE

(71) Applicant: TOYOTA JIDOSHA KABUSHIKI KAISHA, Toyota-shi, Aichi (JP)

(72) Inventors: Akira Yamashita, Sunto-gun (JP); Hiroshi Oyagi, Gotenba (JP); Kazuyasu Iwata, Fuji (JP)

(73) Assignee: Toyota Jidosha Kabushiki Kaisha, Toyota-shi, Aichi-ken (JP)

( * ) Notice: Subject to any disclaimer, the term of this patent is extended or adjusted under 35 U.S.C. 154(b) by 0 days.

(21) Appl. No.: 15/022,618

(22) PCT Filed: Sep. 1, 2014

(86) PCT No.: PCT/JP2014/004479

§ 371 (c)(1),
(2) Date: Mar. 17, 2016

(87) PCT Pub. No.: WO2015/040804

PCT Pub. Date: Mar. 26, 2015

(65) Prior Publication Data

US 2016/0230689 A1 Aug. 11, 2016

(30) Foreign Application Priority Data

Sep. 20, 2013 (JP) ..... 2013-195001

(51) Int. Cl.
*F02D 41/24* (2006.01)
*F02D 35/02* (2006.01)

(52) U.S. Cl.
CPC ..... *F02D 41/247* (2013.01); *F02D 35/025* (2013.01); *F02D 35/028* (2013.01)

(58) Field of Classification Search
CPC .... F02D 41/247; F02D 35/028; F02D 35/025; F02D 41/2429; F02D 41/402;
(Continued)

(56) References Cited

U.S. PATENT DOCUMENTS 5,698,776 A * 12/1997 Tomisawa ..... F02P 5/1455 701/105
2002/0162529 A1* 11/2002 Hasegawa ..... F02D 41/403 123/299

(Continued)

FOREIGN PATENT DOCUMENTS

JP 3-31539 2/1991
JP 8-232820 9/1996

(Continued)

*Primary Examiner* — Joseph Dallo
*Assistant Examiner* — Scott A. Reinbold
(74) *Attorney, Agent, or Firm* — Finnegan, Henderson, Farabow, Garrett & Dunner, LLP

(57) ABSTRACT

The invention relates to a control apparatus of an engine. The apparatus carries out a minute-injection for injecting a minute amount of a fuel so as not to generate an engine torque when a required engine load is zero. The apparatus calculates at least one coefficient for correcting a heat release gravity position calculated when the minute-injection is carried out such that it corresponds to its base position and/or for correcting a heat release rate corresponding the gravity position calculated when the minute-injection is carried out such that it corresponds to its base rate. When the required engine load is larger than zero, the apparatus controls the gravity position corrected by the coefficient to its target position.

5 Claims, 18 Drawing Sheets

G: HEAT RELEASE RATE GRAVITY POINT
W: HEAT RELEASE RATE WAVEFORM
A: REGION
Gca: HEAT RELEASE RATE GRAVITY POSITION
CAs: COMBUSTION STARTING CRANK ANGLE
CAe: COMBUSTION ENDING CRANK ANGLE
dQg: GRAVITY POINT HEAT RELEASE RATE

(58) Field of Classification Search
CPC ..... F02D 35/02; F02D 35/021; F02D 35/023; F02D 35/024
USPC ..... 701/104
See application file for complete search history.

(56) References Cited

U.S. PATENT DOCUMENTS

| | | | | |
|---|---|---|---|---|
| 2005/0274352 | A1 | 12/2005 | Canale et al. | |
| 2007/0119418 | A1* | 5/2007 | Kojima | F02D 35/023 123/305 |
| 2008/0147299 | A1* | 6/2008 | Haraguchi | F02D 35/023 701/103 |
| 2009/0063010 | A1* | 3/2009 | Nakata | F02D 35/028 701/103 |
| 2009/0292447 | A1* | 11/2009 | Yamaguchi | F02D 35/023 701/103 |
| 2011/0077841 | A1* | 3/2011 | Minami | F02D 41/1402 701/104 |
| 2011/0118923 | A1* | 5/2011 | Zeh | B60K 6/46 701/22 |
| 2012/0053819 | A1 | 3/2012 | Yasuda et al. | |
| 2015/0034048 | A1* | 2/2015 | Walter | F02D 41/1498 123/445 |

FOREIGN PATENT DOCUMENTS

| | | |
|---|---|---|
| JP | 2009-209943 | 9/2009 |
| JP | 2010-236534 | 10/2010 |
| JP | 2011-157850 | 8/2011 |
| JP | 2011-202629 | 10/2011 |

* cited by examiner

[Fig. 1]
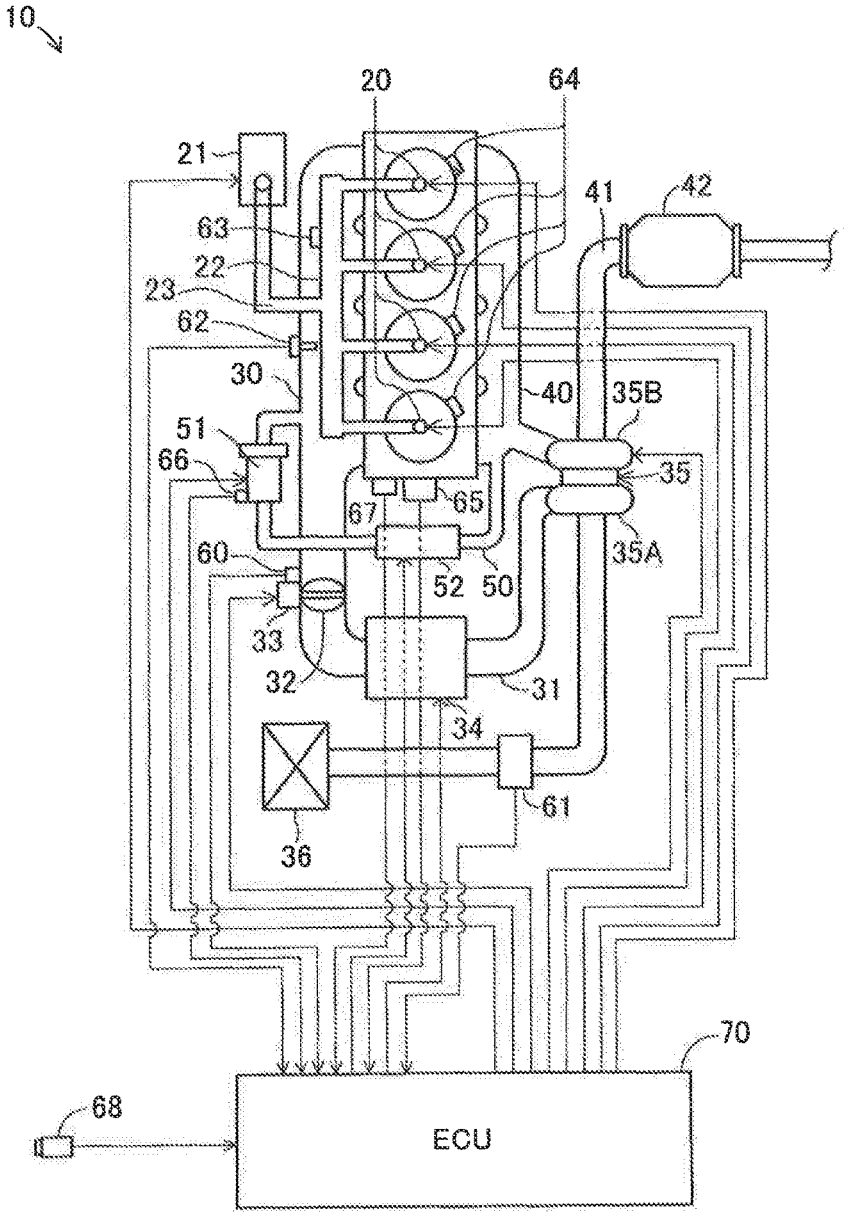

[Fig. 2]
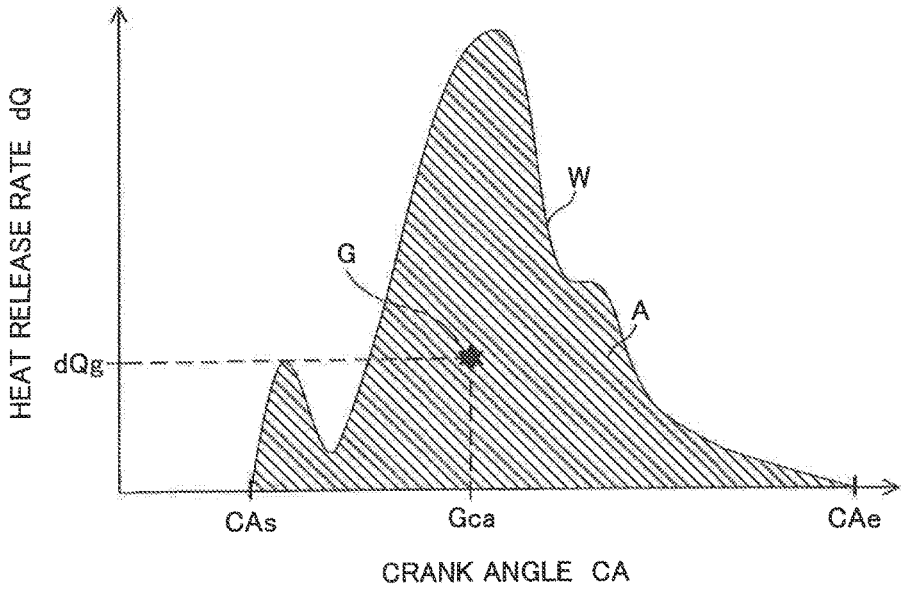
G: HEAT RELEASE RATE GRAVITY POINT
W: HEAT RELEASE RATE WAVEFORM
A: REGION
Gca: HEAT RELEASE RATE GRAVITY POSITION
CAs: COMBUSTION STARTING CRANK ANGLE
CAe: COMBUSTION ENDING CRANK ANGLE
dQg: GRAVITY POINT HEAT RELEASE RATE

[Fig. 3]
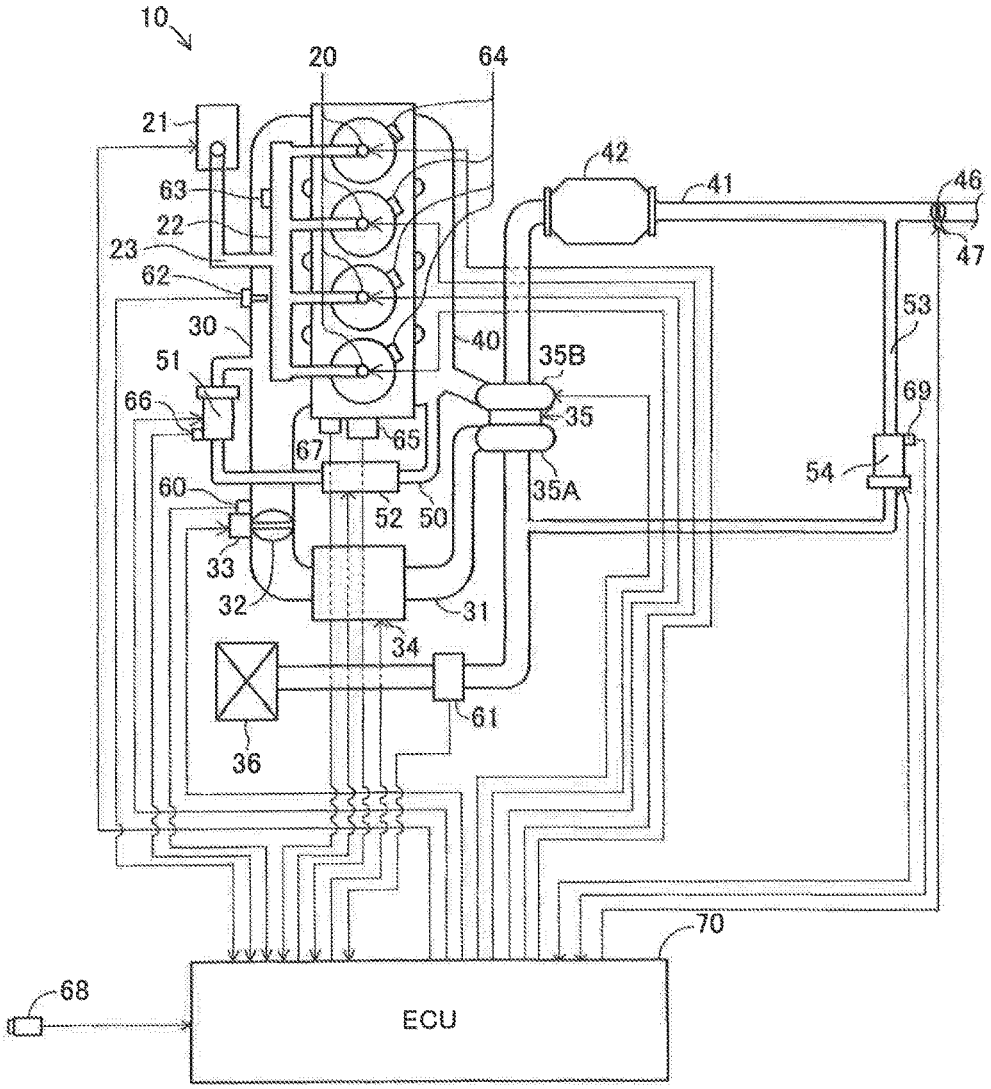

[Fig. 4]
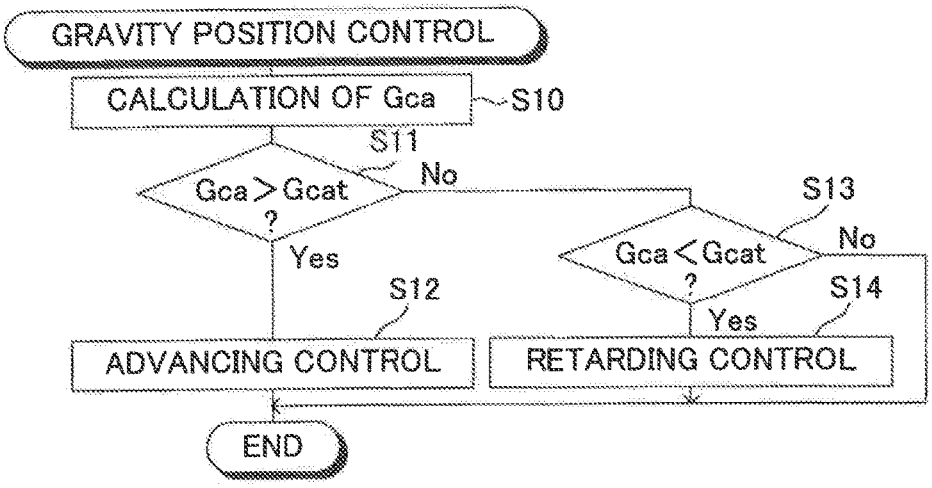
Gca: HEAT RELEASE RATE GRAVITY POSITION
Gcat: TARGET POSITION

[Fig. 5]
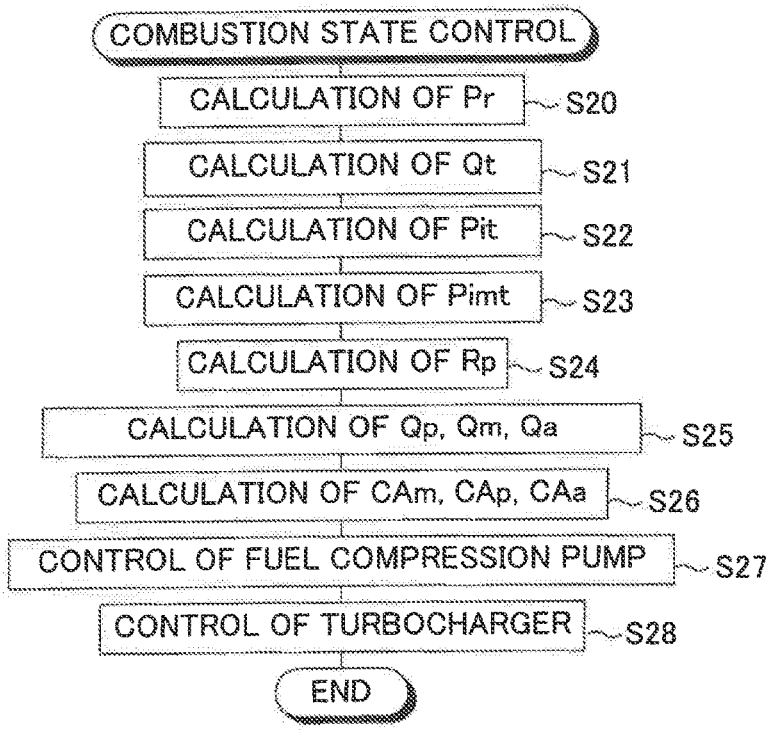
Pr: REQUIRED OUTPUT
Qt: TARGET INJECTION AMOUNT
Pit: TARGET INJECTION PRESSURE
Pimt: TARGET SUPERCHARGING PRESSURE
Rp: PILOT-INJECTION RATE
Qp: PILOT-INJECTION AMOUNT
Qm: MAIN-INJECTION AMOUNT
Qa: AFTER-INJECTION AMOUNT
CAm: MAIN-INJECTION TIMING
CAp: PILOT-INJECTION TIMING
CAa: AFTER-INJECTION TIMING

[Fig. 6]
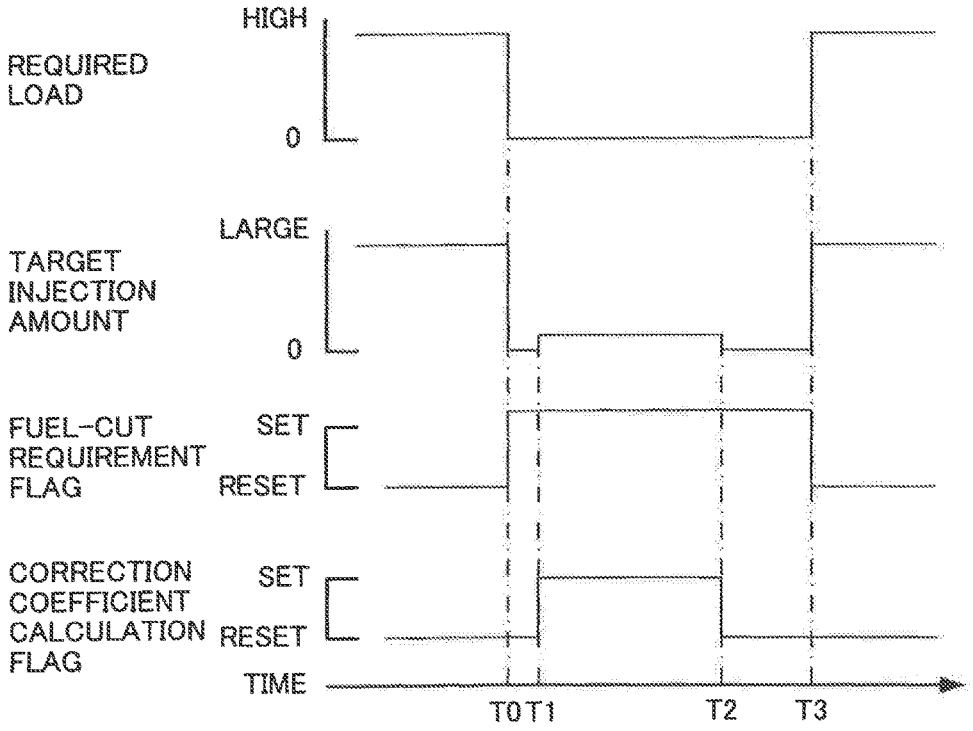

[Fig. 7]

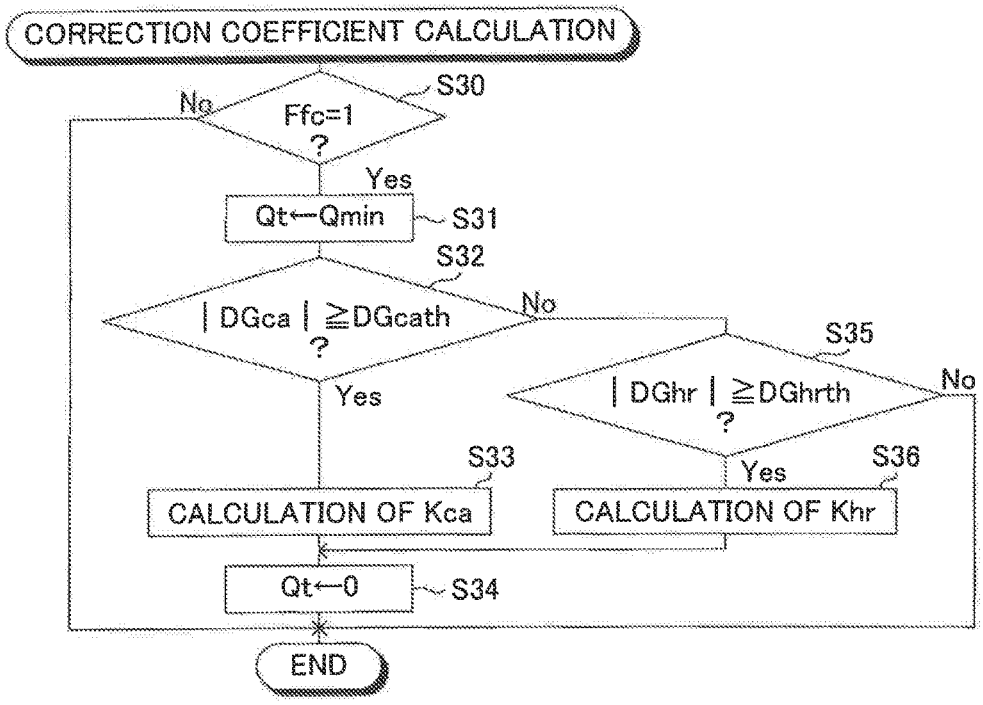

Ffc: FUEL-CUT REQUIREMENT FLAG
Qt: TARGET INJECTION AMOUNT
Qmin: MINUTE-INJECTION AMOUNT
DGca: GRAVITY POSITION DIFFERENCE
DGcath: PREDETERMINED GRAVITY POSITION DIFFERENCE
Kca: GRAVITY POSITION CORRECTION COEFFICIENT
DGhr: HEAT RELEASE RATE DIFFERENCE
DGhrth: PREDETERMINED HEAT RELEASE RATE DIFFERENCE
Khr: HEAT RELEASE RATE CORRECTION COEFFICIENT

[Fig. 8]

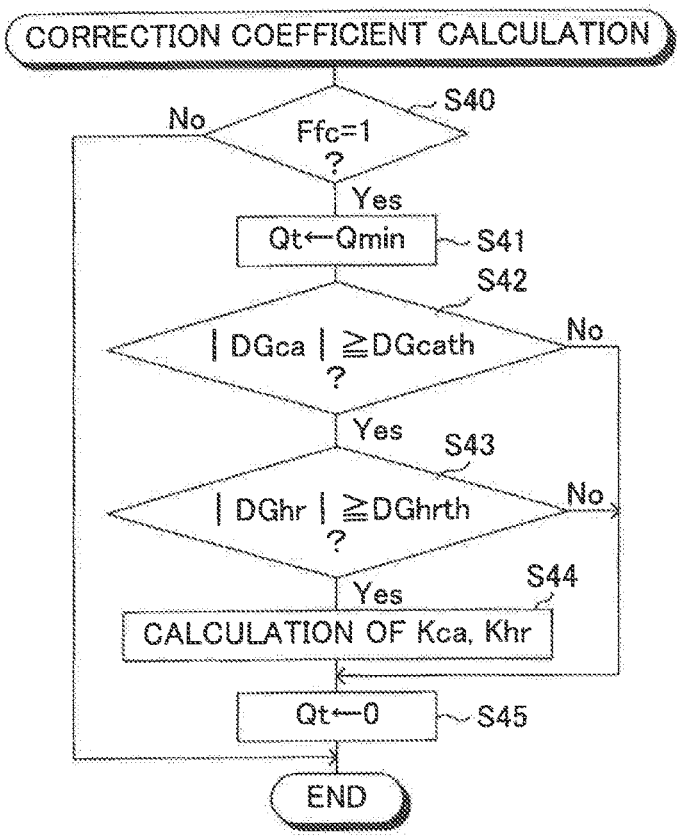

Ffc: FUEL-CUT REQUIREMENT FLAG
Qt: TARGET INJECTION AMOUNT
Qmin: MINUTE-INJECTION AMOUNT
DGca: GRAVITY POSITION DIFFERENCE
DGcath: PREDETERMINED GRAVITY POSITION DIFFERENCE
Kca: GRAVITY POSITION CORRECTION COEFFICIENT
DGhr: HEAT RELEASE RATE DIFFERENCE
DGhrth: PREDETERMINED HEAT RELEASE RATE DIFFERENCE
Khr: HEAT RELEASE RATE CORRECTION COEFFICIENT

[Fig. 9]
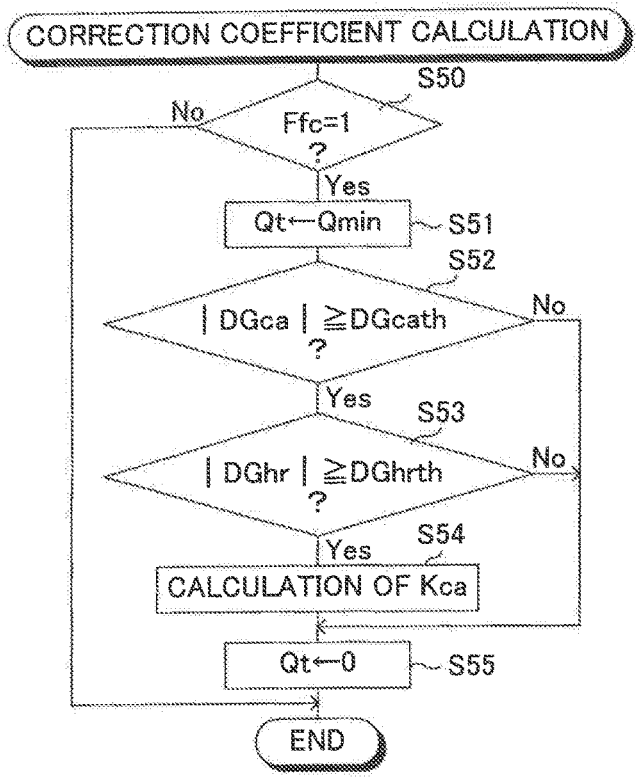
Ffc: FUEL-CUT REQUIREMENT FLAG
Qt: TARGET INJECTION AMOUNT
Qmin: MINUTE-INJECTION AMOUNT
DGca: GRAVITY POSITION DIFFERENCE
DGcath: PREDETERMINED GRAVITY POSITION DIFFERENCE
Kca: GRAVITY POSITION CORRECTION COEFFICIENT
DGhr: HEAT RELEASE RATE DIFFERENCE
DGhrth: PREDETERMINED HEAT RELEASE RATE DIFFERENCE

[Fig. 10]
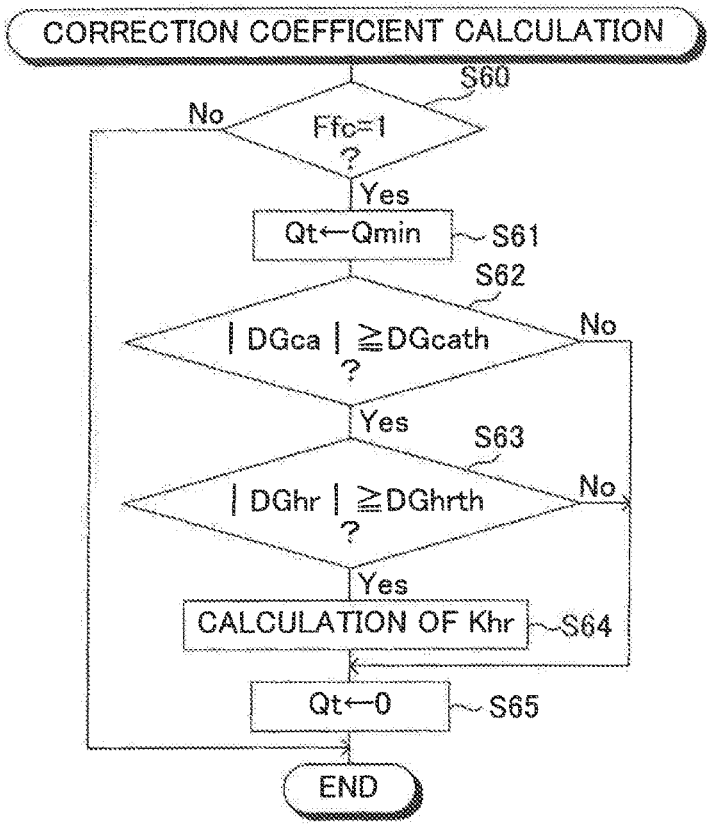
Ffc: FUEL-CUT REQUIREMENT REQUIREMENT FLAG
Qt: TARGET INJECTION AMOUNT
Qmin: MINUTE INJECTION AMOUNT
DGca: GRAVITY POSITION DIFFERENCE
DGcath: PREDETERMINED GRAVITY POSITION DIFFERENCE
DGhr: HEAT RELEASE RATE DIFFERENCE
DGhrth: PREDETERMINED HEAT RELEASE RATE DIFFERENCE
Khr: HEAT RELEASE RATE CORRECTION COEFFICIENT

[Fig. 11]
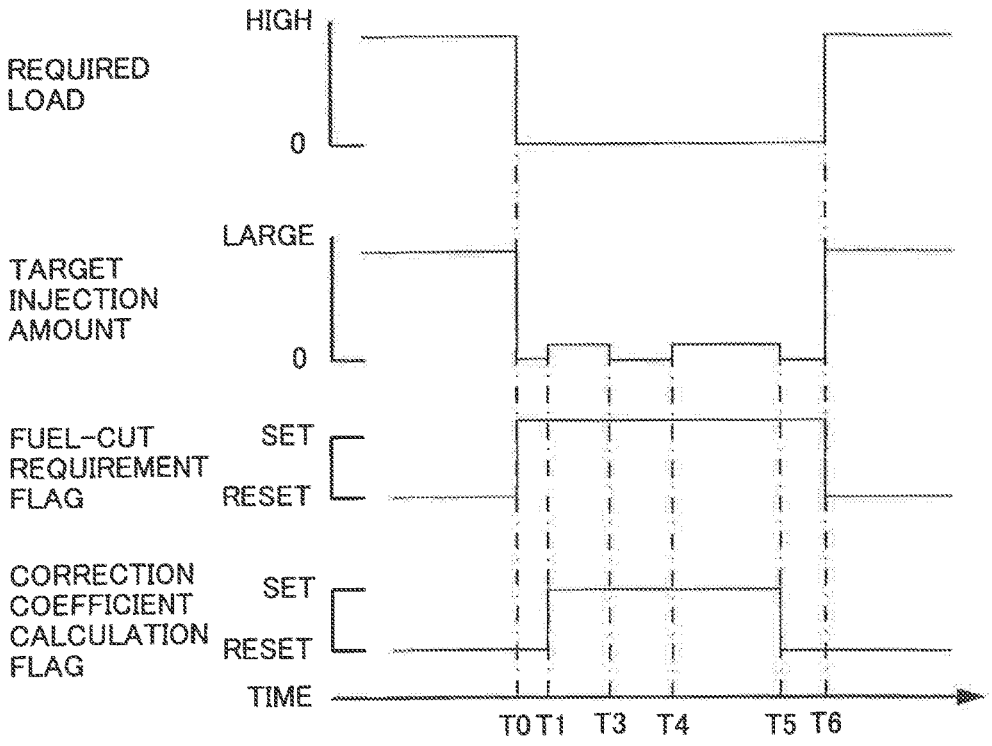

[Fig. 12]

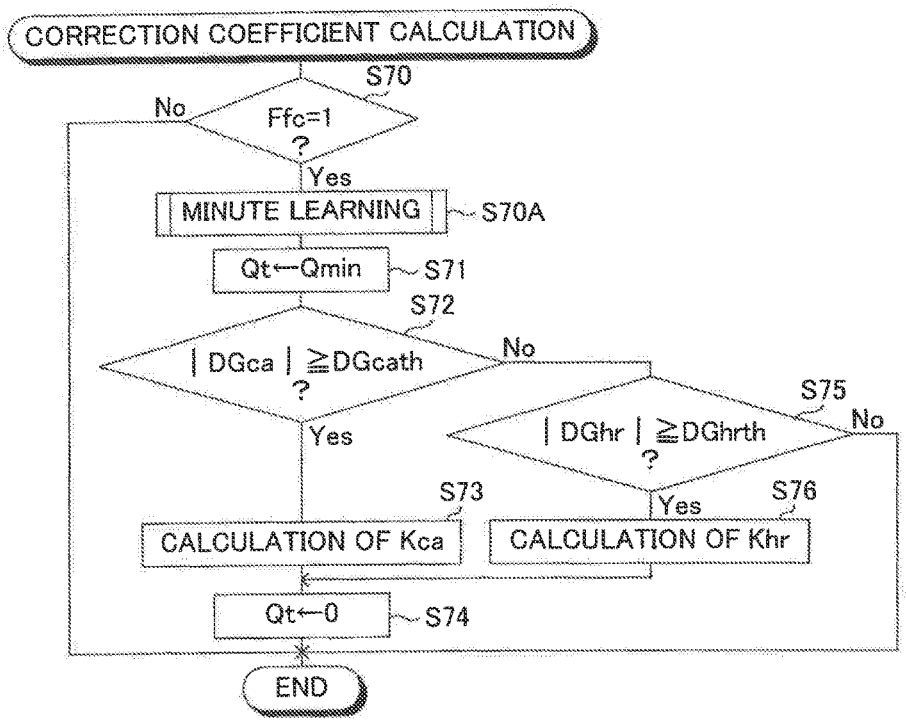

Ffc: FUEL-CUT REQUIREMENT FLAG
Qt: TARGET INJECTION AMOUNT
Qmin: MINUTE-INJECTION AMOUNT
DGca: GRAVITY POSITION DIFFERENCE
DGcath: PREDETERMINED GRAVITY POSITION DIFFERENCE
Kca: GRAVITY POSITION CORRECTION COEFFICIENT
DGhr: HEAT RELEASE RATE DIFFERENCE
DGhrth: PREDETERMINED HEAT RELEASE RATE DIFFERENCE
Khr: HEAT RELEASE RATE CORRECTION COEFFICIENT

[Fig. 13]
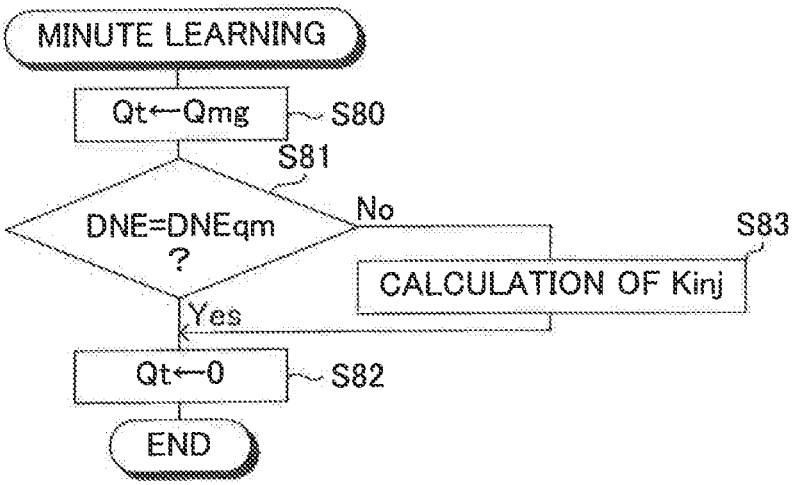
Qt: TARGET INJECTION AMOUNT
Qmg: MINUTE-LEARNING-INJECTION AMOUNT
DNE: ENGINE SPEED CHANGE AMOUNT
DNEgm: PREDETERMINED CHANGE AMOUNT
Kinj: INJECTION CORRECTION COEFFICIENT

[Fig. 17]
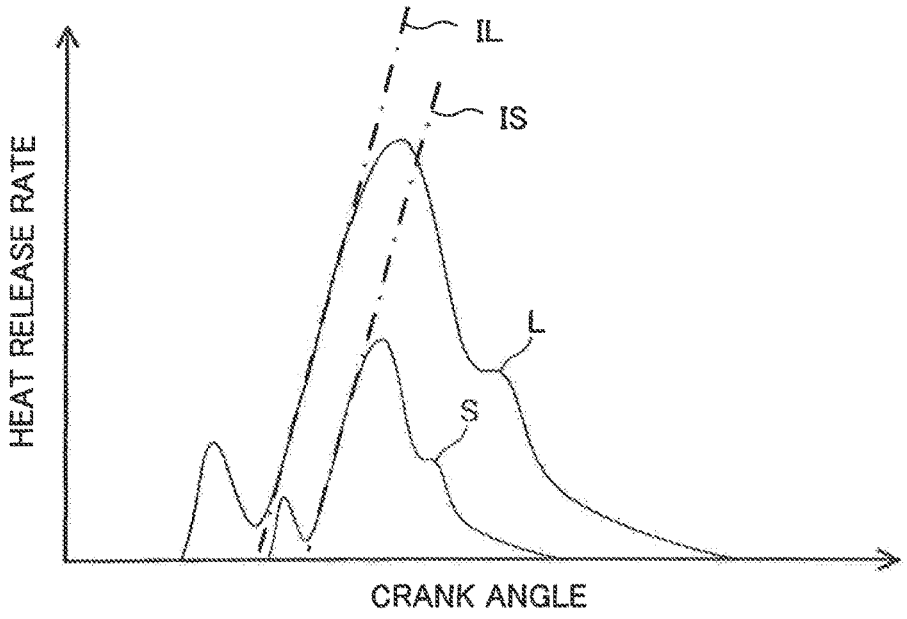

CONTROL APPARATUS OF INTERNAL COMBUSTION ENGINE

CROSS-REFERENCE TO RELATED APPLICATIONS

This application is a national phase application of International Application No. PCT/JP2014/004479, filed Sep. 1, 2014, and claims the priority of Japanese Application No. 2013-195001, filed Sep. 20, 2013, the content of both of which is incorporated herein by reference.

TECHNICAL FIELD

The invention relates to a control apparatus of an internal combustion engine.

BACKGROUND ART

A closed loop electronic control system for controlling a combustion of a diesel engine is described in the JP unexamined patent publication No. 2009-209943.

According to this publication, a premixed compression ignition combustion can be controlled efficiently by changing a fuel injection on the basis of a gravity of a combustion process and its base value.

SUMMARY OF INVENTION

Various control apparatuses applied to an internal combustion engine have been developed for the purpose of decreasing a fuel consumption. Since there are many kinds of engine control parameters which influence the fuel consumption, it is necessary at least to set different target values of the parameters depending on the engine load. By the study of the inventors of this application, it has been realized that a gravity position of a heat release rate, which can minimize the fuel consumption, is constant, independently of the engine load. Therefore, it has been realized that it is possible to considerably easily control combustion control parameters (that is, engine control parameters, which influence the combustion manner in the cylinders) so as to minimize the fuel consumption by using the gravity position of the heat release rate for the purpose of controlling the combustion.

The gravity position of the heat release rate (hereinafter, this position will be also referred to as "heat release rate gravity position" or simply referred to as "gravity position") is calculated by using the heat release rate and a crank angle. The heat release rate is calculated by using a cylinder pressure. The cylinder pressure is calculated on the basis of an output value from a cylinder pressure sensor.

An output error may occur in this sensor due to at least one of its output function, an influence of its harness, its transmission channel and the like. In other words, a sensing error may occur in this sensor (hereinafter, this error will be referred to as "detection error").

Further, if the temperature of the sensor increases to a high temperature, the detection error may occur in this sensor due to the influence of a so-called thermal drift or distortion.

When the detection error occurs in the sensor and thus, the output value thereof does not exactly correspond to an actual cylinder pressure, no exact heat release rate gravity position can be calculated.

In addition, the crank angle is calculated on the basis of an output value from a crank angle sensor. Therefore, if a detection error occurs in this sensor and thus, the output value thereof does not exactly correspond to an actual crank angle, no exact heat release rate gravity position can be calculated.

As described above, if the parameters used for calculating the heat release rate gravity position have errors, no exact heat release rate gravity position can be calculated.

The object of the present invention is to calculate the exact heat release rate gravity position even when the parameters used for calculating the heat release rate gravity position have errors.

A control apparatus of an internal combustion engine according to the present invention comprises:

(1) a parameter acquisition part for acquiring at least one operation state parameter expressing an operation state of the engine; and (2) a gravity position calculation part for calculating a heat release rate gravity position on the basis of the engine state parameter.

The heat release rate gravity position is a following position (crank angle).

That is, as shown in FIG. 2, the heat release rate gravity position Gca is a crank angle CA, which corresponds to a geometric gravity point G of a hatched region A defined by a waveform W of the heat release rate dQ along a crank angle base.

In particular, the gravity position Gca is a crank angle CA, which corresponds to the geometric gravity point G of the region A surrounded by the waveform W drawn in a coordinate system, which is defined by a horizontal axis representing the crank angle CA and a vertical axis representing the heat release rate dQ, and said horizontal axis. The horizontal and vertical axes are orthogonal to each other.

In other words, the gravity position Gca is a crank angle CA, which corresponds to the geometric gravity point G of the region A surrounded by the waveform W of the heat release rate dQ indicated in a graph (for example, said coordinate system), which is defined by one axis (for example, said horizontal axis) representing the crank angle CA in each engine operation cycle and the other axis (for example, said vertical axis) orthogonal to said one axis representing the heat release rate dQ, and said one axis.

That is, the gravity position Gca is a crank angle CA, which corresponds to the geometric gravity point G of the region A defined by the waveform W along the crank angle base.

Further, in other words, the gravity position Gca is a particular crank angle CApca, which satisfies a condition that a value V, obtained by crank-angle-integrating a product P (=(CA−CApca)*dQ(CA)) of a value (CA−CApca) obtained by subtracting the particular crank angle CApca from an optional crank angle CA in each engine operation cycle and the heat release rate dQ(CA) at each optional crank angle CA, is zero (V=0).

That is, the gravity position Gca is a particular crank angle CApca, which satisfies a following formula (1). The particular crank angle CApca is between a start of the combustion and an end of the combustion during a single combustion stroke.

[Math.1]

$$\int_{CAs}^{CAe}(\mathrm{CA}-\mathrm{Gac})dQ(\mathrm{CA})\mathrm{dCA}=0 \quad (1)$$

Further, in other words, the gravity position Gca is a particular crank angle CApca when a value V1, obtained by crank-angle-integrating a product P1 (=(CApca−CA)*dQ(CA)) of a crank angle difference DCA (=CApca−CA) between an optional crank angle CA on the advancing side of the particular crank angle CApca and the particular crank angle CApca, and the heat release rate dQ(CA) at each optional crank angle CA, is equal to a value V2, obtained by crank-angle-integrating a product P2 (=(CA−CApca)*dQ(CA)) of a crank angle difference DCA (=CA−CApca) between an optional crank angle CA on the retarding side of the particular crank angle CApca and the particular crank angle CApca, and the heat release rate dQ(CA) at each optional crank angle CA (V1=V2).

That is, the gravity position Gca is an optional crank angle CA when a summation S1 of a product P1 (=dQ(CA)*D(CA)) of the heat release rate dQ(CA) on the advancing side of the optional crank angle CA and a crank angle distance D(CA) from the optional crank angle CA is equal to a summation S2 of a product P2 (=dQ(CA)*D(CA)) of the heat release rate dQ(CA) on the retarding side of the optional crank angle CA and the crank angle distance D(CA) from the optional crank angle CA (S1=S2).

The crank angle distance D(CA) is a difference between the optional crank angle CA and each crank angle. Therefore, assuming that the crank angle distance D(CA) corresponds a distance from a fulcrum and the heat release rate dQ(CA) corresponds to a force, moments (=the force*the crank angle distance=the crank angle distance D(CA)*the heat release rate dQ(CA)) at either side of the fulcrum are equal to each other.

That is, the gravity position Gca is a particular crank angle CApca when a value V1, obtained by crank-angle-integrating a product P1 (=|DCA|*dQ(CA)) of an absolute value of a difference DCA (=CApca−CA1) between an optional first crank angle CA1 after the start of the combustion and the particular crank angle CApca and the heat release rate dQ(CA) at the optional first crank angle CA1 from the crank angle CAs of the start of the combustion to the particular crank angle CApca, is equal to a value V2, obtained by crank-angle-integrating a product P2 (=|DCA|*dQ(CA)) of an absolute value of a difference DCA (=CA2−CApca) between an optional second crank angle CA2 after the particular crank angle CApca and the particular crank angle CApca and the heat release rate dQ(CA) at the optional second crank angle CA2 from the particular crank angle CApca to the crank angle CAe of the end of the combustion (V1=V2).

That is, the gravity position Gca is a particular crank angle CApca, which satisfies a following formula (2).

In the formula (2), "CAs" is a combustion starting crank angle (that is, a crank angle when the combustion starts, "CAe" is a combustion ending crank angle (that is, a crank angle when the combustion ends, "CA" is an optional crank angle and "dQ(CA)" is a heat release rate at the optional crank angle CA. The particular crank angle CApca is between the start of the combustion and the end of the combustion in the single combustion stroke.

[Math.2]

$$\int_{CAs}^{Gac}(\mathrm{Gac}-\mathrm{CA})dQ(\mathrm{CA})\mathrm{dCA}=\int_{Gac}^{CAe}(\mathrm{CA}-\mathrm{Gac})dQ(\mathrm{CA})\mathrm{dCA} \quad (2)$$

Further, in other words, the gravity position Gca is a heat release rate gravity position obtained by the calculation on the basis of a following formula (3).

[Math. 3]

$$Gac=\frac{\int_{CAs}^{CAe}(CA-CAs)\,dQ(CA)dCA}{\int_{CAs}^{CAe}dQ(CA)dCA}+CAs \quad (3)$$

That is, the gravity position Gca is a value (IV/Aa+CAs), obtained by adding the combustion starting crank angle CAs to a value IV/Aa obtained by dividing a crank-angle-integration value IV of a product P (=DCA*dQ(CA)) of the difference DCA (=CA−CAs) between the optional crank angle CA and the combustion starting crank angle CAs and the heat release rate dQ(CA) at the optional crank angle CA by the area Aa of the region A defined by the waveform W of the heat release rate dQ(CA) along the crank angle base.

That is, the gravity position Gca is a value (IV/Aa+CAs), obtained by adding the combustion starting crank angle CAs to a value TV/Aa obtained by dividing a crank-angle-integration value IV of a product P (=D*dQ(CA)) of the crank angle distance D and the heat release rate dQ(CA) corresponding thereto by the area Aa of the region A defined by the waveform W of the heat release rate dQ(CA) along the crank angle base. The crank angle distance D is a difference between the combustion starting crank angle CAs and each crank angle CA.

The control apparatus according to the present invention further comprises:

(3) a part for carrying out a minute-injection for injecting a minute amount of a fuel from a fuel injector so as not to generate an engine torque when a required load of the engine is zero;

(4) a part for previously memorizing at least one of:

(a) a base position corresponding to the heat release rate gravity position when the minute-injection is carried out under the state that the operation state parameter has no error, and (b) a base rate corresponding to the heat release rate corresponding to one of the heat release rate gravity position and a heat release rate gravity point when the minute-injection is carried out under the state that the operation state parameter has no error;

(5) a correction coefficient calculation part for calculating at least one of:

(c) a gravity position correction coefficient for correcting a reference position corresponding to the heat release rate gravity position calculated by the gravity position calculation part when the minute-injection is carried out such that the reference position corresponds to the base position, and (d) a heat release rate correction coefficient for correcting a reference rate corresponding to the heat release rate corresponding to one of the heat release rate gravity position calculated by the gravity position calculation part and the heat release rate gravity point when the minute-injection is carried out such that the reference rate corresponds to the base rate; and (6) a part for carrying out at least one of:

(e) a correction process for correcting the heat release rate gravity position calculated by the gravity position calculation part by the gravity position correction coefficient when the required load is larger than zero, (f) a correction process for correcting the heat release rate gravity position calculated by the gravity position calculation part by the heat release rate correction coefficient when the required load is larger than zero; and (7) a control part for controlling the corrected heat release rate gravity position to a target position by changing at least one combustion parameter for controlling a combustion state in a combustion chamber of the engine when the required load is larger than zero.

As described above, when the parameter acquisition part has an error, no exact heat release rate gravity rate can be calculated.

Such an error appears as at least one of:

(1) a gravity position difference between the base position and the gravity position calculated when the minute-injection is carried out (the reference position), and (2) a heat release rate difference between the base rate and the heat release rate corresponding to one of the gravity position and the gravity point when the minute-injection is carried out (the reference rate).

According to the present invention, calculated is at least one of the gravity position correction coefficient and the heat release rate correction coefficient for reducing the gravity position difference and the heat release rate difference to zero, respectively.

Further, when the required load is larger than zero, the calculated gravity position is corrected by the gravity position correction coefficient and/or the heat release rate correction coefficient. Thereby, the corrected gravity position may correspond to an actual gravity position.

Therefore, according to the present invention, the exact gravity point is calculated.

It should be noted that when the heat release rate gravity position calculated at a particular operation state after the required load becomes zero is different from that calculated at the particular operation state before the required load becomes zero, it can be considered that the calculation of the correction coefficient according to the present invention is carried out.

The correction coefficient calculation part may calculate only one of the gravity position correction coefficient and the heat release rate correction coefficient.

Thereby, the control load due to the correction of the heat release rate gravity position can be maintained at a low level.

The control apparatus may further comprise:

(8) a part for carrying out a learning-injection for injecting a small amount of the fuel from the fuel injector so as to generate an extremely small engine torque when the required load is zero;

(9) a part for previously memorizing a base amount corresponding to an amount of a change of an engine torque when the learning-injection is carried out under the state that the amount of the fuel injected from the fuel injector has no error;

(10) a torque change amount acquisition part for acquiring a torque change amount corresponding to the amount of the change of the engine torque;

(11) a part for calculating a fuel injection amount correction coefficient for correcting the amount of the fuel injected from the fuel injector such that the torque change amount acquired by the torque change amount acquisition part corresponds to the base amount when the learning-injection is carried out; and

(12) an injection amount correction part for correcting the amount of the fuel injected from the fuel injector by the fuel injection amount correction coefficient when the required load is larger than zero.

In this case, the correction coefficient calculation part may calculate at least one of the gravity position correction coefficient and the heat release rate correction coefficient when the amount of the fuel is corrected by the injection amount correction coefficient.

The parameter acquisition part may include a sensor for detecting a pressure in the combustion chamber. In this case, the operation state parameter is the pressure in the combustion chamber.

The parameter acquisition part may include a sensor for detecting a crank angle. In this case, the operation state parameter includes the crank angle.

The target position may be constant, independently of the required load and/or an engine speed.

BRIEF DESCRIPTION OF DRAWINGS

FIG. 1 shows an internal combustion engine having a control apparatus according to a first embodiment.

FIG. 2 shows a view used for describing the heat release rate gravity position.

FIG. 3 shows another internal combustion engine having the control apparatus according to the first embodiment.

FIG. 4 shows a heat release rate gravity position control flow according to the first embodiment.

FIG. 5 shows a combustion state control flow according to the first embodiment.

FIG. 6 shows a time chart used for describing a calculation of a correction coefficient according to the first embodiment.

FIG. 7 shows a correction coefficient calculation flow according to the first embodiment.

FIG. 8 shows a correction coefficient calculation flow according to a second embodiment.

FIG. 9 shows a correction coefficient calculation flow according to a third embodiment.

FIG. 10 shows a correction coefficient calculation flow according to a fourth embodiment.

FIG. 11 shows a time chart used for describing the calculation of the correction coefficient according to a fifth embodiment.

FIG. 12 shows a correction coefficient calculation flow according to the fifth embodiment.

FIG. 13 shows a minute learning flow according to the fifth embodiment.

FIG. 17 shows a view used for describing a relationship between a combustion waveform and an engine sound.

DESCRIPTION OF EMBODIMENTS

Figure 14A:
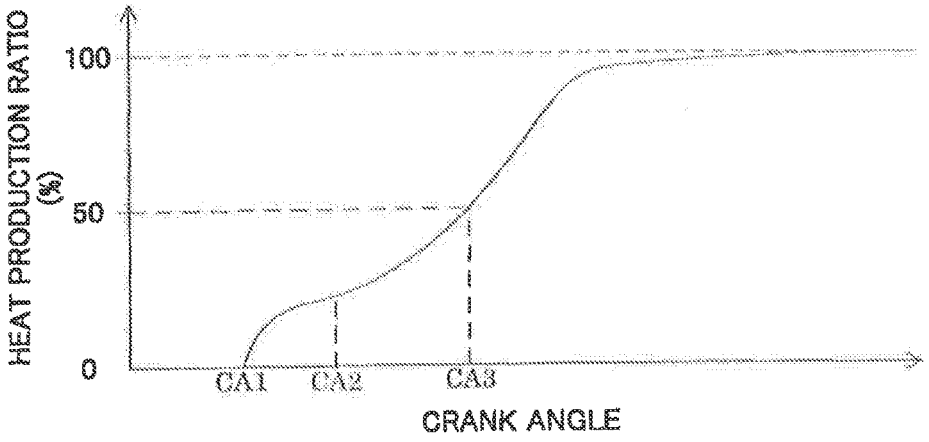
FIG. 14(A) shows a relationship between the crank angle and the heat generation amount ratio when a pilot-injection is carried out at a particular crank angle and FIG. 14(B) shows a relationship between the crank angle and the heat generation amount ratio when the pilot-injection is carried out at a crank angle advanced from the particular crank angle.

Below, embodiments according to the invention will be described with reference to the drawings. FIG. 1 shows an internal combustion engine having a control apparatus according to a first embodiment of the invention. This engine is a compression ignition multi-cylinder internal combustion engine (a so-called diesel engine) where a plurality of fuel injections are carried out during a single engine cycle (that is, an engine cycle including four strokes, that is, intake, compression, combustion and exhaust strokes), in particular, during a single compression stroke. The engine has four cylinders (four combustion chambers).

In FIG. 1, 10 denotes the engine, 20 denote fuel injectors, 21 denotes a fuel pump, 22 denotes an accumulation chamber (a common rail), 23 denotes a fuel supply pipe.

Further, 30 denotes an intake manifold, 31 denotes an intake pipe, 32 denotes a throttle valve, 33 denotes a throttle valve actuator, 34 denotes an intercooler, 35 denotes a turbocharger, 35A denotes a compressor of the turbocharger 35, 35B denotes a turbine of the turbocharger 35, 36 denotes an air cleaner.

Furthermore, 40 denotes an exhaust manifold, 41 denotes an exhaust pipe, 42 denotes an exhaust gas purification catalyst, 50 denotes an EGR pipe, 51 denotes an EGR valve, 52 denotes an EGR cooler.

Further, 60 denotes a throttle valve opening degree sensor, 61 denotes an air flow meter, 62 denotes an intake pressure sensor, 63 denotes a fuel pressure sensor, 64 denotes a cylinder pressure sensor, 65 denotes a crank angle sensor, 66 denotes an EGR valve opening degree sensor, 67 denotes a water temperature sensor, 68 denotes an acceleration pedal depression amount sensor and 70 denotes an electronic control unit (hereinafter, this unit will be referred to as "ECU").

The intake manifold 30 and the intake pipe 31 constitute an intake passage. The exhaust manifold 40 and the exhaust pipe 41 constitute an exhaust passage.

The EGR pipe 50, the EGR valve 51 and the EGR cooler 52 constitute an EGR apparatus (hereinafter, this apparatus will be referred to as "high pressure EGR apparatus"). This high pressure EGR apparatus introduces an exhaust gas from the exhaust passage (in particular, the exhaust manifold 40) upstream of the turbine 35B to the intake passage (in particular, the intake manifold 30) downstream of the compressor 35A.

The fuel injectors 20 are mounted on the engine 10 corresponding to the combustion chambers, respectively so as to inject a fuel directly into the corresponding combustion chambers. Therefore, the engine 10 has four fuel injectors 20.

The ECU 70 is electrically connected to the fuel injectors 20, the fuel pump 21, the throttle valve actuator 33, the intercooler 34, the turbine 35B, the EGR valve 51 and the EGR cooler 52.

During the operation of the engine 10, the ECU 70 outputs a signal for injecting the fuel from the injectors 20, a signal for controlling an operation state of the fuel pump 21 to control a fuel pressure Pf, a signal for controlling an operation state of the throttle valve actuator 33 to control an opening degree of the throttle valve 32, a signal for controlling a cooling ability of the intercooler 34, a signal for controlling at least one of an operation state of nozzle vanes (not shown) of the turbine 35B and an operation state of a turbine bypass valve (not shown) to control a supercharging pressure, a signal for controlling an operation state of the EGR valve 51 to control an opening degree of the EGR valve 51 and a signal for controlling a cooling ability of the EGR cooler 52.

By these signals, the fuel injection, the fuel pressure Pf, the opening degree of the throttle valve 32 (as a result, an EGR rate Regr, that is, an intake air amount Ga and/or an EGR amount Gegr), the cooling ability of the intercooler 34, the supercharging pressure Pim, the opening degree of the EGR valve 51 (as a result, the EGR rate Regr, that is, the EGR amount Gegr and/or the intake air amount Ga) and the cooling ability of the EGR cooler 52 are controlled.

The fuel pressure Pf is one of a pressure of the fuel in the accumulation chamber 22, a pressure of the fuel in the fuel supply pipe 23 and a pressure of the fuel between the accumulation chamber 22 and the fuel injector 20 (in particular, a pressure of the fuel in the fuel injector 20).

When the fuel injector 20 has a fuel pressure sensor, the pressure in the fuel injector 20 is detected by this fuel pressure sensor.

The supercharging pressure Pim is a pressure of an intake air compressed by the compressor 35A.

The EGR rate Regr is a ratio Gegr/Gtotal of the EGR amount Gegr to a gas amount Gtotal suctioned into the combustion chamber. The intake air amount Ga is an amount of the air suctioned into the combustion chamber. The EGR amount Gegr is an amount of an EGR gas introduced into the intake air by the high pressure EGR apparatus. The EGR gas is an exhaust gas introduced into the intake gas by the high pressure EGR apparatus.

The nozzle vanes are arranged upstream of the turbine 35B and controls an amount of the exhaust gas flowing into the turbine 35B by controlling its rotation position.

The turbine bypass valve is arranged in a bypass passage, through which the exhaust gas bypasses the turbine 35B, and controls the amount of the exhaust gas flowing into the turbine 35B by controlling its opening degree.

The ECU 70 is electrically connected to the air flow meter 61 and the sensors 62 to 68.

The air flow meter 61 sends a signal corresponding to the intake air amount Ga to the ECU 70. The ECU 70 calculates the intake air amount Ga on the basis of this signal.

The fuel pressure sensor 63 sends a signal corresponding to the fuel pressure Pf to the ECU 70. The ECU 70 calculates the injection pressure Pi on the basis of this signal.

The cylinder pressure sensor 64 sends a signal corresponding to the cylinder pressure Pc to the ECU 70. The ECU 70 calculates a heat release rate dQ on the basis of this signal.

The crank angle sensor 65 sends a signal corresponding to the rotation phase of a crank shaft (not shown) to the ECU 70. The ECU 70 calculates an engine speed NE on the basis of this signal.

The EGR valve opening degree sensor 66 sends a signal corresponding to the opening degree of the EGR valve 51 to the ECU 70. The ECU 70 calculates the opening degree of the EGR valve 51 on the basis of this signal.

The water temperature sensor 67 sends a signal corresponding to an engine cooling water temperature THW (that is, a temperature of a cooling water which cools the engine 10) to the ECU 70. The ECU 70 calculates the cooling water temperature THW on the basis of this signal.

The acceleration pedal depression amount sensor 68 sends a signal corresponding to a depression amount of an acceleration pedal to the ECU 70. The ECU 70 calculates an engine load KL on the basis of this signal.

The injection pressure Pi is a pressure of the fuel injected from the fuel injector 20. The cylinder pressure Pc is a pressure of the gas in the combustion chamber. The heat release rate dQ is a heat release speed (that is, an amount of the heat generated in the combustion chamber per unit crank angle). This rate dQ may be calculated on the basis of an ion current generated due to the combustion.

The catalyst 42 has a function for purifying a NOx (a nitrogen oxide) included in the exhaust gas. In particular, the catalyst 42 is a NSR catalyst (that is, a NOx absorption and reduction catalyst), which absorbs therein the NOx included in the exhaust gas when an air-fuel ratio of the exhaust gas flowing thereinto is leaner than the stoichiometric air-fuel ratio and reduces and purifies the NOx absorbed therein and included in the exhaust gas flowing thereinto when the air-fuel ratio of the exhaust gas flowing thereinto is richer than the stoichiometric air-fuel ratio.

The catalyst 42 purifies the NOx at a purification rate higher than or equal to a predetermined purification rate when its temperature is higher than or equal to a predetermined temperature.

The present invention can be applied to a case that the catalyst is another catalyst other than the NSR catalyst. The catalyst 42 may be one of a three-way catalyst, a SCR catalyst and an oxidation catalyst.

The three way catalyst has a function for purifying the NOx, a CO (a carbon monoxide) and a HC (an unburned hydrocarbon) included in the exhaust gas simultaneously at a high purification rate when the air-fuel ratio of the exhaust gas flowing thereinto corresponds to the stoichiometric air-fuel ratio. This three-way catalyst can purify the NOx, the CO and the HC at a purification rate higher than or equal to a predetermined purification rate when its temperature is higher than or equal to a predetermined temperature.

The SCR catalyst has a function for purifying the NOx by using an ammonia as a reduction agent. This SCR catalyst can purify the NOx at a purification rate higher than or equal to a predetermined purification rate when its temperature is higher than or equal to a predetermined temperature.

The oxidation catalyst purifies (oxidizes) the CO and the HC included in the exhaust gas. This oxidation catalyst can purify the CO and the HC at a purification rate higher than or equal to a predetermined purification rate when its temperature is higher than and equal to a predetermined temperature.

According to the first embodiment, a heat release rate gravity position is used as a control index for a combustion control. Below, the combustion control using this gravity position will be also referred to as "gravity position control".

The heat release rate gravity position will be described. The heat release rate gravity position means a position as follows.

As shown in FIG. 2, the heat release rate gravity position Gca is a crank angle corresponding to a geometric gravity point G of a hatched region A defined by a waveform W of the heat release rate dQ along the crank angle base.

In particular, the gravity position Gca is a crank angle corresponding to the geometric gravity point G of the region A between "the waveform W of the heat release rate dQ drawn on a coordinate system defined by a horizontal axis of the crank angle CA and a vertical axis of the heat release rate dQ" and "the horizontal axis". The horizontal and vertical axes are orthogonal to each other.

That is, the heat release rate gravity position Gca is a crank angle corresponding to the geometric gravity point G of the region A between "the waveform W of the heat release rate dQ drawn on a graph (in this embodiment, the aforementioned coordinate system) having an axis (in this embodiment, the aforementioned horizontal axis) of the crank angle CA during each engine cycle and the other axis (in this embodiment, the aforementioned vertical axis) of the heat release rate dQ orthogonal to the aforementioned one axis" and "the aforementioned one axis".

That is, the gravity position Gca is a crank angle corresponding to the geometric gravity point G of the region A defined by the waveform W of the heat release rate dQ along the crank angle base.

Further, in other words, the gravity position Gca is a particular crank angle CApca when a value V, obtained by crank-angle-integrating a product P (=(CA−CApca)*dQ) of a value (CA−CApca) obtained by subtracting the particular crank angle CApca from an optional crank angle CA during each engine cycle and the heat release rate dQ at the optional crank angle CA, is zero (V=0).

That is, the gravity position Gca is a particular crank angle CApca which satisfies a following formula (1). The particular crank angle CApca is between a combustion start and a combustion end during one combustion stroke.

[Math.4]

$$\int_{CAs}^{CAe}(\mathrm{CA}-\mathrm{Gac})dQ(\mathrm{CA})\mathrm{dCA}=0 \quad (1)$$

Further, in other words, the gravity position Gca is a particular crank angle CApca when a value V1, obtained by crank-angle-integrating a product P1 (=DCA*dQ(CA)) of a crank angle difference DCA (=CApca−CA) between the optional crank angle CA on the advancing side of the particular crank angle CApca and the particular crank angle CApca and the heat release rate dQ(CA) at the optional crank angle CA, is equal to a value V2, obtained by crank-angle-integrating a product P2 (=DCA*dQ(CA)) of a crank angle difference DCA (=CA−CApca) between the optional crank angle CA on the retarding side of the particular crank angle CApca and the particular crank angle CApca and the heat release rate dQ(CA) at the optional crank angle CA (V 1=V2).

That is, the gravity position Gca is an optional crank angle CA when a summation S1 of the product P1 (=D*dQ(CA)) of the heat release rate dQ(CA) on the advancing side of the optional crank angle CA and the crank angle distance D from the optional crank angle CA corresponding to the heat release rate dQ(CA), is equal to a summation S2 of the product P2 (=D*dQ(CA)) of the heat release rate dQ(CA) on the retarding side of the optional crank angle CA and the crank angle distance D from the optional crank angle CA corresponding to the heat release rate dQ(CA) (S1=S2).

The crank angle distance D is a difference between the optional crank angle CA and each crank angle. Therefore, assuming that the gravity position Gca corresponds to a fulcrum, the crank angle distance D corresponds to a distance from the fulcrum and the heat release rate dQ(CA) corresponds to a force, the moments (=the force*the distance=the crank angle distance D*the heat release rate dQ(CA)) at either side of the fulcrum are equal to each other.

That is, the gravity position Gca is a particular crank angle qpca when a value V1, obtained by crank-angle-integrating the product P1 (=|DCA|*dQ(CA)) of the absolute value of the difference DCA (=CA1−CApca) between an optional first crank angle CA1 after the combustion starting crank angle CAs and the particular crank angle CApca from the combustion starting crank angle CAs to the particular crank angle CApca, is equal to a value V2, obtained by crank-angle-integrating the product P2 (=|DCA|*dQ(CA)) of the absolute value of the difference DCA (=CA2−CApca) between an optional second crank angle CA2 after the particular crank angle CApca and the particular crank angle CApca from the particular crank angle CApca to the combustion ending crank angle CAe (V1=V2).

That is, the gravity position Gca is a particular crank angle CApca which satisfies a following formula (2).

In the formula (2), "CAs" is a crank angle when the combustion starts (the combustion starting crank angle), "CAe" is a crank angle when the combustion ends (the combustion ending crank angle), "CA" is the optional crank angle and "dQ(CA)" is the heat release rate at the optional crank angle CA.

The particular crank angle CApca is between the combustion starting crank angle CAs and the combustion ending crank angle CAe during one combustion stroke.

[Math.5]

$$\int_{CAs}^{Gac}(\mathrm{Gac}-\mathrm{CA})dQ(\mathrm{CA})\mathrm{dCA}=\int_{Gac}^{CAe}(\mathrm{CA}-\mathrm{Gac})dQ(\mathrm{CA})\mathrm{dCA} \quad (2)$$

Further, in other words, the gravity position Gca is a gravity position acquired by the calculation on the basis of a following formula (3).

[Math. 6]

$$Gac = \frac{\int_{CAs}^{CAe}(CA - CAs)\,dQ(CA)dCA}{\int_{CAs}^{CAe}dQ(CA)dCA} + CAs \quad (3)$$

That is, the gravity position Gca is a value (IV/Aa+CAs) obtained by adding the combustion starting crank angle CAs to a value IV/Aa obtained by dividing the crank-angle-integration value IV of the product P (=(CAs−CA)*dQ(CA)) of a difference DCA (=CAs−CA) between the optional crank angle CA and the combustion starting crank angle CAs and the heat release rate dQ(CA) at the optional crank angle CA by the area Aa of the region A defined by the waveform W of the heat release rate dQ(CA) along the crank angle base.

That is, the gravity position Gca is a value (IV/Aa+CAs), obtained by adding the combustion starting crank angle CAs to a value IV/Aa obtained by dividing the crank-angle-integration value IV of the product P (=(CA−CAs)*dQ(CA)) of the crank angle distance DCA (=CA−CAs) and the heat release rate dQ(CA) corresponding thereto by the area Aa of the region A defined by the waveform W of the heat release rate dQ(CA) along the crank angle base.

The crank angle distance D is a difference (CA−CAs) between the combustion starting crank angle CAs and the crank angle CA.

The heat release rate dQg at the heat release rate gravity position Gca can be calculated by a following formula (4).

[Math. 7]

$$dQg = \frac{\int_{CAs}^{CAe}dQ^2(CA)dCA}{\int_{CAs}^{CAe}dQ(CA)dCA} \quad (4)$$

When the exact combustion starting crank angle CAs cannot be realized, a crank angle surely on the advancing side of the combustion starting crank angle CAs (in this embodiment, 20 degrees before a compression top dead center BTDC) may be used as the combustion starting crank angle CAs.

Similarly, when the exact combustion ending crank angle CAe cannot be realized, a crank angle surely on the retarding side of the combustion ending crank angle CAe (in this embodiment, 90 degrees after the compression top dead center ATDC) may be used as the combustion ending crank angle CAe.

In the first embodiment, the combustion considered for the calculation of the gravity position Gca is the combustion of pilot-, main- and after-injection fuels and the combustion of the post injection fuel is not considered for calculating the gravity position Gca.

The main-injection is carried out at a timing around the compression top dead center TDC.

The pilot-injection is carried out at a timing before the main-injection at least so as to generate a torque.

The after-injection is carried out at a timing after the main-injection for increasing the exhaust gas temperature and activating the catalyst 42 at least so as to generate a torque.

The post injection is carried out after the after-injection (in this embodiment, after the 90 degrees ATDC) and no torque is generated by the combustion of the fuel injected by this injection.

The gravity position control according to the first embodiment will be described. In this control, the gravity position Gca is calculated according to the aforementioned calculation rule. Then, a value of at least one combustion control parameter described later is controlled such that the calculated gravity position Gca corresponds to the target position Gcat (=the optimal crank angle). At the same time, the value of the combustion control parameter is controlled such that an output required for the engine 10 (a required output) is output from the engine 10.

The aforementioned target position Gcat is a constant crank angle, independently of the engine load KL and/or the engine speed NE, when the engine load KL is at least within a predetermined engine load range. Therefore, in the gravity position control, the gravity position Gca is controlled to the constant crank angle, independently of the engine load KL and/or the engine speed NE.

In this embodiment, the target position Gcat is 7 degrees after the compression top dead center (ATDC). When the gravity position Gca is controlled to the target position Gcat, the fuel consumption is minimum and thus, the target position Gcat is a crank angle which minimizes a summation of the cooling and exhaust losses.

By the gravity position control according to the first embodiment, the fuel consumption decreases. Further, the control index for accomplishing the combustion state which minimizes the fuel consumption is only the gravity position Gca. Thus, even when there are a number of the combustion control parameters, the values of the combustion control parameters for accomplishing the combustion state which minimize the fuel consumption can be determined with a low adaptation load.

The gravity position control may be carried out, independently of the engine load KL, that is, at the entire engine load region or only when the engine load KL is within a predetermined engine load range. Further, the gravity position control may be carried out at only one of the combustion chambers or at some of the combustion chambers or at all combustion chambers. When the gravity position control is carried out at all combustion chambers, the effect of decreasing the fuel consumption increases.

Further, the gravity position control may control the gravity position Gca to the target position Gcat by a feedback or feedforward control.

The gravity position control by the feedback control (hereinafter, this control will be referred to as "feedback gravity position control") will be described. In this case, the target position Gcat is previously obtained by an experiment or the like and this obtained target position Gcat is memorized in the ECU 70.

During the gravity position control, the target position Gcat memorized in the ECU 70 is set as the target position. Then, the actual gravity position Gca is calculated.

When this calculated gravity position Gca is on the advancing side of the target position Gcat or on the advancing side of the target position Gcat by a predetermined angle, the gravity position Gca is retarded.

On the other hand, when the calculated gravity position Gca is on the retarding side of the target position Gcat or on the retarding side of the target position Gcat by a predetermined angle, the gravity position Gca is advanced.

Thus, the gravity position Gca is feedback-controlled to the target position Gcat (or the gravity position Gca is feedback-controlled so as to approach the target position Gcat).

Thereby, even when information relating to the optimal combination of the combustion control parameters at each engine operation state previously obtained by an experiment or the like is not memorized or even when the individual difference of the engine 10 and the change of the property of the engine 10 occurs, the combustion state (that is, the value of the combustion control parameter) is controlled such that the gravity position Gca corresponds to the target position Gcat. As a result, the fuel consumption can be surely decreased.

The combustion control parameter(s) for controlling the gravity position Gca (in other words, the combustion control parameter for controlling the combustion state) is/are at least one or more of the following (1) to (11).

(1) Main injection timing CAm.

(2) Pilot injection timing CAp.

(3) Main injection amount Qm when the pilot-injection is carried out.

(4) Pilot injection amount Qp.

(5) After injection amount Qa.

(6) Injection pressure Pi.

(7) Supercharging pressure Pim.

(8) Intercooler cooling ability.

(9) EGR cooler cooling ability.

(10) Swirl strength.

(11) Tumble strength.

The intercooler ability can be controlled by whether or not a cooling medium bypasses a heat exchanger of the intercooler 34 or by changing a rate of the cooling medium which passes through the heat exchanger.

Similarly, the EGR cooler cooling ability can be controlled by whether or not a cooling medium bypasses a heat exchanger of the EGR cooler 52 or by changing a rate of the cooling medium which passes through the heat exchanger.

For example, as means for advancing the gravity position Gca (the gravity position advancing means), the control apparatus uses one or more of the following (1) to (12).

(1) Advancing of the main-injection timing CAm.

(2) Advancing of the pilot-injection timing CAp.

(3) Decreasing of the main-injection amount Qm when the pilot-injection is carried out.

(4) Increasing of the pilot-injection amount Qp.

(5) Combination of the increasing of the pilot-injection amount Qp and the decreasing of the main-injection amount Qm.

(6) Decreasing of the after-injection amount Qa.

(7) Increasing of the injection pressure Pi.

(8) Increasing of the supercharging pressure Pim.

(9) Decreasing of the intercooler cooling ability (for example, the carrying out of the control for making the cooling medium bypass the heat exchanger of the intercooler 34 or the decreasing of the rate of the cooling medium which passes through the heat exchanger).

(10) Decreasing of the EGR cooler cooling ability (for example, the carrying out of the control for making the cooling medium bypass the heat exchanger of the EGR cooler 52 or the decreasing of the rate of the cooling medium which passes through the heat exchanger).

(11) Increasing of the swirl strength.

(12) Increasing of the tumble strength.

The increasing of the pilot-injection amount Qp is accomplished by increasing the injection amount per pilot-injection and/or by adding a new pilot-injection (that is, by increasing the number of the pilot-injections).

The increasing of the after-injection amount Qa is accomplished by increasing the injection amount per after-injection and/or by adding a new after-injection (that is, by increasing the number of the after-injection).

Further, a pilot heat release rate gravity position (hereinafter, this position will be referred to as "pilot gravity position") can be used as the combustion control parameter. The pilot gravity position is a crank angle corresponding to the geometric gravity point of the region defined by the waveform of a pilot heat release rate along the crank angle base. The pilot heat release rate is a heat release rate by the combustion of the pilot-injection fuel.

As the means for advancing the pilot gravity position, one or more of the following (1) to (3) can be used.

(1) Advancing of the pilot-injection timing CAp.

(2) Increasing of the number of the pilot-injection before the present pilot gravity position.

(3) Decreasing of the number of the pilot-injection after the present pilot gravity position.

The injection amount is an amount of the fuel injected from the fuel injector 20.

The swirl is a flow of the gas which circles in the combustion chamber generally about a cylinder bore center axis.

The tumble is a flow of the gas which circles in the combustion chamber generally about an axis perpendicular to the cylinder bore center axis.

Further, the EGR rate Regr (or the EGR amount Gegr) can be used as the combustion control parameter. In this case, the decreasing of the EGR rate Regr can be used as the gravity position advancing means.

Further, as shown in FIG. 3, when the engine 10 comprises an EGR apparatus for introducing the exhaust gas from the exhaust passage downstream of the catalyst 42 to the intake passage upstream of the compressor 35A (hereinafter, this apparatus will be referred to as "low pressure EGR apparatus"), one or more of the following (1) to (3) can be used as the combustion control parameter.

(1) Total EGR rate Regr_total (or total EGR amount Gegr_total).

(2) High pressure EGR rate Regr_high (or high pressure EGR amount Gegr_high).

(3) Low pressure EGR rate Regr_low (or low pressure EGR amount Gegr_low).

In this case, one or more of the following (1) to (3) can be used as the gravity position advancing means.

(1) Decreasing of the total EGR rate Regr_total.

(2) Decreasing of the high pressure EGR rate Regr_high.

(3) Increasing of the low pressure EGR rate Regr_low.

In the engine 10 shown in FIG. 3, the total EGR rate Regr_total is a ratio (Gegr_total/Gtotal) of the EGR amount Gegr_total to the amount Gtotal of the gas suctioned into the combustion chamber.

The high pressure EGR rate Regr_high (=Gegr_high/Gegr_total) is a ratio of a high pressure EGR amount Gegr_high to the total EGR amount Gegr_total.

The total EGR amount Gegr_total is a total amount of the EGR gas suctioned into the combustion chamber.

The high pressure EGR amount Gegr_high is an amount of the EGR gas introduced into the intake air by the high pressure EGR apparatus.

The low pressure EGR rate Regr_low is a ratio (Gegr_low/Gegr_total) of a low pressure EGR amount Gegr_low to the total EGR amount Gegr_total.

The low pressure EGR amount Gegr_low is an amount of the EGR gas introduced into the intake air by the low pressure EGR apparatus.

Further, in FIG. 3, 46 denotes an exhaust throttle valve, 47 denotes an exhaust throttle valve actuator, 53 denotes an EGR pipe, 54 denotes an EGR valve and 69 denotes an EGR valve opening degree sensor. The ECU 70 is electrically connected to the exhaust throttle valve actuator 47 and the EGR valve 54.

The ECU 70 outputs a signal for controlling an operation state of the EGR valve 54 to control an opening degree of the EGR valve 54. By this signal, the opening degree of the EGR valve 54 (as a result, the low pressure EGR rate Regr_low, as a result, the total EGR rate Regr_total) is controlled.

Further, the ECU 70 outputs a signal for controlling an operation state of the exhaust throttle valve actuator 47 to control an opening degree of the exhaust throttle valve 46. By this signal, the opening degree of the exhaust throttle valve 46 (as a result, the low pressure EGR rate Regr_low, as a result, the total EGR rate Regr_total) is controlled. An EGR valve opening degree sensor 69 is electrically connected to the ECU 70. This sensor 69 sends a signal corresponding to the opening degree of the EGR valve 54 to the ECU 70. The ECU 70 calculates the opening degree of the EGR valve 54 on the basis of this signal.

The other configuration of the engine 10 shown in FIG. 3 is the same as that of the engine 10 shown in FIG. 1.

As means for retarding the gravity position Gca (the gravity position retarding means), one or more of the following (1) to (12) can be used.

(1) Retarding of the main-injection timing CAm.

(2) Retarding of the pilot-injection timing CAp.

(3) Increasing of the main-injection amount Qm when the pilot-injection is carried out.

(4) Decreasing of the pilot-injection amount Qp.

(5) Combination of the decreasing of the pilot-injection amount Qp and the increasing of the main-injection amount Qm.

(6) Increasing of the after-injection amount Qa.

(7) Decreasing of the injection pressure Pi.

(8) Decreasing of the supercharging pressure Pim.

(9) Increasing of the intercooler cooling ability (for example, the stop of the control for making the cooling medium bypass the heat exchanger of the intercooler 34 or the increasing of the rate of the cooling medium which passes through the heat exchanger).

(10) Increasing of the EGR cooler cooling ability (for example, the stop of the control for making the cooling medium bypass the heat exchanger of the EGR cooler 52 or the increasing of the rate of the cooling medium which passes through the heat exchanger).

(11) Decreasing of the swirl strength.

(12) Decreasing of the tumble strength.

The decreasing of the pilot-injection amount Qp is accomplished by decreasing the injection amount per pilot-injection when the number of the pilot-injections is constant or omitting some of the pilot-injections (that is, the decreasing of the number of the pilot-injections) when a plurality of the pilot-injections are carried out) or by stopping the pilot-injection or the like.

Further, the pilot gravity position can be used as the combustion control parameter. As the means for retarding the pilot gravity position, one or more of following means (1) to (3) can be used.

(1) Retarding of the pilot-injection timing CAp.

(2) Decreasing of the number of the pilot-injections before the present pilot gravity position.

(3) Increasing of the number of the pilot-injection after the present pilot gravity position.

Further, the increasing of the EGR rate Regr can be used as the gravity position retarding means. In the engine 10 shown in FIG. 3, one or more of the following means (1) to (3) can be used as the gravity position retarding means.

(1) Increasing of the total EGR rate Regr_total.

(2) Increasing of the high pressure EGR rate Regr_high.

(3) Decreasing of the low pressure EGR rate Regr_low.

The gravity position control by the feedforward control (hereinafter, this control will be referred to as "feedforward gravity position control") will be described. In this case, the target position Gcat is previously obtained by an experiment or the like. Further, a value of at least one combustion control parameter (or a combination of a plurality of the combustion control parameter values), which can accomplish the target position Gcat, every the engine operation state is previously obtained as a base value by an experiment or the like. This base value (or these base values) is memorized in the ECU 70 in the form of a map as a function of the engine operation state.

During the gravity position control, the base value corresponding to the engine operation state is calculated from the map and then, this calculated base value is set as the target value Gcat. Then, each combustion control parameter value is controlled to the corresponding target value Gcat. Thus, the gravity position Gca is controlled to the target position Gcat.

In this case, each combustion control parameter value may be feedback-controlled to the target value.

If the combustion control parameter value is maintained at the target value, the gravity position Gca retards as the engine speed NE increases and on the other hand, the gravity position Gca advances as the engine speed NE decreases.

In the feedforward gravity position control, as the engine speed NE increases, the control apparatus may carry out at least one of the following (1) to (6).

(1) Advancing of the target value of the main- and/or pilot-injection timing CAm and/or CAp.

(2) Decreasing of the target value of the main- and/or after-injection amount Qm and/or Qa.

(3) Increasing of the target value of the pilot-injection amount Qp.

(4) Increasing of the target value of the injection and/or supercharging pressure Pinj and Pim.

(5) Decreasing of the target value of the intercooler and/or EGR cooler cooling ability.

(6) Increasing of the target value of the swirl and/or tumble strength.

Further, in the feedforward gravity position control, when the cooling water temperature THW is higher than or equal to a predetermined cooling water temperature THWth and the intake air temperature Ta is lower than a predetermined intake air temperature Tath or when the temperature THW is lower than the predetermined temperature THWth and the temperature Ta is higher than or equal to the predetermined temperature Tath or when the temperature THW is lower than the predetermined temperature THWth and the temperature Ta is lower than the predetermined temperature Tath, as the engine speed NE increases, the control apparatus may carry out at least one of the following (1) and (2).

(1) Increasing of at least one of the target value of the EGR rate Regr, the total EGR rate Regr_total and the high pressure EGR rate Regr_high.

(2) Decreasing of the target value of the low pressure EGR rate Regr_low.

Further, in the feedforward gravity position control, when the cooling water temperature THW is higher than or equal to the predetermined cooling water temperature THWth and the intake air temperature Ta is lower than or equal to the predetermined intake air temperature Tath, as the engine speed NE increases, the control apparatus may carry out at least one the following (1) and (2).

(1) Decreasing of the target value of at least one of the total EGR rate Regr_total and the high pressure EGR rate Regr_high.

(2) Increasing of the target value of the low pressure EGR rate Regr_low.

Referring to FIG. 4, the gravity position control flow according to the first embodiment will be described. When the flow shown in FIG. 4 starts, at first, at the step S10, the gravity position Gca is calculated. Next, at the step S1, it is judged if the gravity position Gca calculated at the step S10 is on the retarding side of the target position Gcat. When it is judged that the gravity position Gca is on the retarding side of the target position Gcat, the flow proceeds to the step S12 where the advancing control for advancing the gravity position Gca is carried out and thereafter, the flow ends. On the other hand, when it is not judged that the gravity position Gca is on the retarding side of the target position Gcat, the flow proceeds to the step S13.

At the step S13, it is judged if the gravity position Gca calculated at the step S10 is on the advancing side of the target position Gcat. When it is judged that the gravity position Gca is on the advancing side of the target position Gcat, the flow proceeds to the step S14 where the retarding control for retarding the gravity position Gca is carried out and thereafter, the flow ends. On the other hand, when it is not judged that the gravity position Gca is on the advancing side of the target position Gcat, the flow ends directly.

Referring to FIG. 5, the combustion state control flow according to the first embodiment will be described. The flow shown in FIG. 5 is carried out every a predetermined time has elapsed.

In the following description, a target output is a target value of the output of the engine 10.

A target injection amount Qt is a target value of the amount of the fuel injected from the fuel injector 20.

A target injection pressure Pit is a target value of the pressure of the fuel injected from the fuel injector 20.

A target supercharging pressure Pimth is a target value of the pressure in the intake passage downstream of the compressor 35A of the turbocharger 35.

A pilot-injection rate is a rate of the amount of the fuel injected by the pilot-injection to the target injection amount Qt.

When the flow shown in FIG. 5 starts, at first, at the step S20, the required output Pr is calculated on the basis of the acceleration pedal depression amount and the vehicle speed. Next, at the step S21, the target injection amount Qt is calculated on the basis of the required output Pr calculated at the step S20. Next, at the step S22, the target injection pressure Pit is calculated on the basis of the required output Pr calculated at the step S20. Next, at the step S23, the target supercharging pressure Pimt is calculated on the basis of the required output Pr calculated at the step S20. Next, at the step S24, the pilot-injection rate Rp (which is larger than or equal to "0" and is smaller than "1") is calculated on the basis of the cooling water temperature THW and the engine speed NE.

Next, at the step S25, the pilot- and main-injection amounts Qp and Qm are calculated on the basis of the target injection amount Qt calculated at the step S21 and the pilot-injection rate a calculated at the step S24 and the after-injection amount Qa is calculated. The pilot-injection amount Qp is a value obtained by multiplying the target injection amount Qt by the pilot-injection rate Rp (=Q*Rp). The main-injection amount Qm is a value (=Q−Qp=Q*(1−Rp)) obtained by subtracting the pilot-injection amount Qp from the target injection amount Qt.

Next, at the step S26, the main-, pilot- and after-injection timings CAm, CAp and CAa are calculated on the basis of the required output Pr, the target injection amount Qt, the target injection pressure Pit, the target supercharging pressure Pimt and the pilot-injection rate a calculated at the step S20 to the step S24, respectively.

Next, at the step S29, the operation of the fuel compression pump 21 is controlled such that the injection pressure Pi corresponds to the target injection pressure Pit calculated at the step S22. Next, at the step S28, the operation of the turbocharger 35 is controlled such that the supercharging pressure Pim corresponds to the target supercharging pressure Pimt calculated at the step S23.

The gravity position control according to the first embodiment will be described. In this control, the gravity position calculation parameter is corrected by the correction coefficient Kca or Khr calculated by the correction coefficient calculation control described later. The gravity position calculation parameter is a parameter used for the calculation of the gravity position Gca and, in the first embodiment, is the heat release rate dQ or the crank angle position q.

Further, according to the first embodiment, the gravity position Gca is calculated according to the calculation rule of the gravity position Gca by using the gravity position calculation parameter corrected by the correction coefficient Kca or Khr.

The heat release rate dQ is calculated by using the cylinder pressure Pc. Therefore, the cylinder pressure Pc may be used as the gravity position calculation parameter to be corrected by the correction coefficient Kca or Khr.

Further, when at least one of the engine speed NE, the engine load KL, the intake air amount Ga, the intake air temperature Ta, the intake air pressure Pim and the fuel injection amount Q is used for calculating the gravity position Gca as the gravity position calculation parameter, these gravity position calculation parameters may be used as the gravity position calculation parameter to be corrected by the correction coefficient Kca or Khr.

When a constant is used in the calculation rule of the gravity position Gca, this constant may be used as the gravity position calculation parameter to be corrected by the correction coefficient Kca or Khr.

The gravity position Gca calculated according to the calculation rule may be corrected by using the uncorrected gravity position calculation parameter or constant. The gravity position Gca calculated according to the calculation rule may be corrected by using the corrected gravity position calculation parameter or constant.

The correction of the gravity position calculation parameter by the correction coefficient Kca or Khr according to the first embodiment corresponds to a correction of the gravity position Gca.

The correction coefficient calculation control according to the first embodiment will be described. This control calculates the correction coefficient Kca or Khr. In the following description, a minute-injection amount Qmin is a fuel injection amount which does not generate a torque (or which generate an extremely small torque or no change or an extremely small change of the engine speed NE).

According to the first embodiment, the gravity position Gca and the heat release rate dQg corresponding to the gravity point G as shown in FIG. 2 (hereinafter, this heat release rate will be referred to as "gravity point heat release rate") when the minute-injection amount Qmin of the fuel is injected from the fuel injector 20 at a predetermined timing under the state that the gravity position calculation parameter has no error, are previously obtained by an experiment or the like. These gravity position Gca and gravity point heat release rate dQg are memorized in the ECU 70 as base position Gcab and base heat release rate dQgb, respectively.

The correction coefficient calculation control according to the first embodiment is carried out when the required load KLr is zero. When this control is carried out, the minute-injection amount Qmin is set as the target injection amount Qt. Thereby, the minute-injection amount Qmin of the fuel is injected from the fuel injector 20.

Then, the present gravity position Gca and the present gravity point heat release rate dQg are calculated.

Then, a difference DGca (=Gcab−Gca) between the calculated gravity position Gca and the base position Gcab (hereinafter, this difference will be referred to as "gravity position difference") and a difference DdQg (=dQgb−dQg) between the calculated gravity point heat release rate dQg and the base heat release rate dQgb are calculated.

When the gravity position difference DGca is larger than or equal to a predetermined gravity position difference DGcath, the correction coefficient Kca for eliminating this difference DGca (hereinafter, this coefficient will be referred to as "gravity position correction coefficient") is calculated.

Further, when the heat release rate difference DdQg is larger than or equal to a predetermined heat release rate difference DdQgth, the correction coefficient Khr for eliminating this difference DdQg (hereinafter, this coefficient will be referred to as "heat release rate correction coefficient") is calculated.

In addition, when the gravity position difference DGca is larger than or equal to the predetermined gravity position difference DGcath and the heat release rate difference DdQg is larger than or equal to the predetermined heat release rate difference DdQgth, the gravity position and heat release rate correction coefficients Kca and Khr are calculated.

The thus calculated correction coefficients Kca and Khr are those for correcting the heat release rate or the crank angle used in the calculation rule of the gravity position Gca.

When the calculated gravity position Gca is smaller than the base position Gcab (the calculated gravity position Gca is on the advancing side of the base position Gcab), in the correction coefficient calculation control, the gravity position correction coefficient Kca is calculated as a coefficient for correcting the gravity position calculation parameter such that the larger gravity position Gca is calculated.

When the calculated gravity position Gca is larger than the base position Gcab (the calculated gravity position Gca is on the retarding side of the base position Gcab), the gravity position correction coefficient Kca is calculated as a coefficient for correcting the gravity position calculation parameter such that the smaller gravity position Gca is calculated.

Further, when the calculated gravity point heat release rate dQg is smaller than the base heat release rate dQgb, in the correction coefficient calculation control, the heat release rate correction coefficient Khr is calculated as a coefficient for correcting the gravity position calculation parameter such that the larger gravity point heat release rate dQg is calculated.

When the calculated gravity point heat release rate dQg is larger than the base heat release rate dQgth, the heat release rate correction coefficient Khr is calculated as a coefficient for correcting the gravity position calculation parameter such that the smaller gravity point heat release rate dQg is calculated.

The heat release rate dQ is calculated by using the cylinder pressure Pc. Therefore, the correction coefficients Kca and Khr may correct the cylinder pressure Pc used for calculating the gravity position Gca.

Further, when at least one of the engine speed NE, the engine load KL, the intake air amount Ga, the intake air temperature Ta, the intake air pressure Pim and the fuel injection amount Q is used for calculating the gravity position Gca as the gravity position calculation parameter, the correction coefficients Kca and Khr may correct this gravity position calculation parameter.

When a constant is used in the calculation rule of the gravity position Gca, the correction coefficients Kca and Khr may correct this constant.

Further, the correction coefficients Kca and Khr may correct the gravity position Gca calculated according to the calculation rule by using the uncorrected gravity position calculation parameter or by using the corrected gravity position calculation parameter or constant.

The calculation of the correction coefficients Kca and Khr according to the first embodiment is a calculation of the correction coefficients for correcting the gravity position Gca.

When the correction coefficients Kca and Khr are already calculated, the calculation of the correction coefficients Kca and Khr according to the first embodiment corresponds to the correction or update of the already calculated correction coefficients Kca and Khr.

According to the first embodiment, a condition that the required load KLr is zero is used as a condition of carrying out the correction coefficient calculation control. However, for example, a condition that a fuel-cut engine operation is carried out may be used as the condition of carrying out the correction coefficient calculation control. The fuel-cut engine operation is an operation of the engine 10 where no fuel injection for generating a torque is carried out.

Further, known is a hybrid system which outputs a power by appropriately combining the power of the engine 10 and the power of the electrical motor. The first embodiment can be applied to this hybrid system. In this case, as the condition of carrying our the correction coefficient calculation control, a condition that the required load KLr of the engine 10 is zero, independently of whether the required load of the hybrid system or the electrical motor is zero, may be used.

In the first embodiment, in place of the gravity point heat release rate dQg, the heat release rate dQgca at the gravity position Gca may be used for calculating the heat release rate correction coefficient Khr. In this case, the heat release rate dQgca at the gravity position Gca (the gravity position heat release rate) when the minute-injection amount Qmin of the fuel is injected from the fuel injector 20 under the state that the gravity position calculation parameter has no error, is previously obtained by an experiment or the like and this gravity position heat release rate dQgca is memorized in ECU 70 as base heat release rate dQgcab.

When the correction coefficient calculation control is carried out under the state that the required load KLr is zero and the minute-injection amount Qmin of the fuel is injected from the fuel injector 20, the present gravity position heat release rate dQgca is calculated.

Then, a difference DdQgca (=dQgcab−dQgca) between the calculated gravity position heat release rate dQgca and the base heat release rate dQgcab is calculated. When this difference DdQgca is larger than or equal to the predetermined heat release rate difference DdQgcath, the correction coefficient for eliminating this difference DdQgca is calculated as the heat release rate correction coefficient Khr.

Referring to FIG. 6, the calculation of the correction coefficients Kca and Khr according to the first embodiment will be described.

In the following description, a fuel-cut requirement flag Ffc is set when the required load KLr becomes zero and is reset when the torque TQ is required (that is, when the required load KLr is not zero).

A correction coefficient calculation flag Fccc is set when the calculation of at least one of the gravity position and heat release rate correction coefficients Kca and Khr is required. On the other hand, the flag Fccc is reset when the desired correction coefficient Kca or Khr is calculated.

As shown in FIG. 6, before the time T0, the required load KLr is not zero and therefore, an amount depending on the required load KLr (this amount is larger than zero) is set as the target injection amount Qt. Further, the fuel-cut requirement and correction coefficient calculation flags Ffc and Fccc are being reset.

When the required load KLr becomes zero at the time T0, the fuel-cut requirement flag Ffc is set and then, zero is set as the target injection amount Qt.

Then, at the time T1, the correction coefficient calculation flag Fccc is set. Thereby, the calculation of the correction coefficient Kca or Khr is carried out. At this time, the minute-injection amount Qmin is set as the target injection amount Qt. The calculation of the correction coefficient Kca or Khr is continued until the correction coefficient calculation flag Fccc is reset at the time T2.

When the calculation of the correction coefficient Kca or Khr ends at the time T2, zero is set as the target injection amount Qt.

When the required load KLr becomes larger than zero at the time T3, the fuel-cut requirement flag Ffc is reset and the amount depending on the required load KLr (this amount is larger than zero) is set as the target injection amount Qt.

By the gravity position correction control according to the first embodiment, the exact gravity position Gca can be calculated. That is, according to the first embodiment, the heat release rate dQ and the crank angle q are used for calculating the gravity position Gca. The cylinder pressure Pc is used for the calculation of the heat release rate dQ.

The cylinder pressure Pc is calculated on the basis of the output value from the cylinder pressure sensor 64. Therefore, if this sensor 64 has a detection error and its output value does not correspond to a value corresponding exactly to the actual cylinder pressure Pc, no exact gravity position Gca can be calculated.

Further, the crank angle CA is calculated on the basis of the output value from the crank angle sensor 65. Therefore, if this sensor 65 has a detection error and its output value does not correspond to a value corresponding exactly to the actual crank angle CA, no exact gravity position Gca is calculated.

These detection errors of the cylinder pressure and crank angle sensors 64 and 65 appear as a difference of the heat release rate gravity point G. That is, these errors appear as the difference of the calculated gravity position Gca and the difference of the heat release rate dQg corresponding to the heat release rate gravity point G (that is, the gravity point heat release rate dQg shown in FIG. 2).

By the gravity position correction control according to the first embodiment, the gravity position calculation parameter (the heat release rate dQ calculated by using the cylinder pressure Pc calculated on the basis of the output value of the cylinder pressure sensor 64 and the crank angle CA calculated on the basis of the output value of the crank angle sensor 65) is corrected on the basis of the differences of the calculated gravity position Gca and the gravity point heat release rate dQg. Thus, the exact gravity position Gca can be calculated.

Referring to FIG. 7, the correction coefficient calculation flow according to the first embodiment will be described. When the flow shown in FIG. 7 starts, at first, at the step S30, it is judged if the fuel-cut requirement flag Ffc is set (Ffc=1). When it is judged that Ffc=1, the flow proceeds to the step S31. On the other hand, when it is not judged that Ffc=1, the flow ends directly.

At the step S31, the minute-injection amount Qmin is set as the target injection amount Qt. Next, at the step S32, it is judged if the absolute value of the gravity position difference DGca is larger than or equal to the predetermined gravity position difference DGcath. When it is judged that the absolute value of the difference DGca is larger than or equal to the predetermined difference DGcath, the flow proceeds to the step S33 where the gravity position correction coefficient Kca is calculated and thereafter, the flow proceeds to the step S34. On the other hand, when it is not judged that the absolute value of the difference DGca is larger than or equal to the predetermined difference DGcath, the flow proceeds to the step S35.

At the step S35, it is judged if the absolute value of the heat release rate difference DdQg is larger than or equal to the predetermined heat release rate difference DdQgth. When it is judged that the absolute value of the difference DdQg is larger than or equal to the predetermined difference DdQgth, the flow proceeds to the step S36 where the heat release rate correction coefficient Khr is calculated and thereafter, the flow proceeds to the step S34. On the other hand, when it is not judged that the absolute value of the difference DdQg is larger than or equal to the predetermined difference DdQgth, the flow ends directly.

At the step S34, zero is set as the target injection amount Qt and thereafter, the flow ends.

The second embodiment will be described. In the several embodiments described below, the configuration and the control of each embodiment which are not described are the same as those of the other embodiment described in this description or are those obviously derived from the other embodiment in consideration of the configuration and the control of each embodiment.

The correction coefficient calculation control according to the second embodiment will be described. This control is carried out when the required load KLr is zero. When this control is carried out, the minute-injection amount Qmin is set as the target injection amount Qt. Thereby, the minute-injection amount Qmin of the fuel is injected from the fuel injector 20.

Then, the present gravity position Gca and the present gravity point heat release rate dQg are calculated. Then, the gravity position and heat release rate differences DGca and DdQg are calculated.

When these differences DGca and DdQg are larger than or equal to the predetermined gravity position and heat release rate differences DGcath and DdQgth, respectively, the gravity position and heat release rate correction coefficients Kca and Khr for eliminating these differences DGca and DdQg are calculated.

By the gravity position correction control according to the second embodiment, for the same reason as that described relating to the first embodiment, the exact gravity position Gca can be calculated. In addition, only when both of the gravity position Gca and the gravity point heat release rate dQg have the differences, respectively and therefore, the difference of the calculated gravity position Gca should be corrected, the difference of the gravity position G is corrected. Therefore, the load of the ECU 70 due to the correction control can be decreased.

Referring to FIG. 8, the correction coefficient calculation flow according to the second embodiment will be described. When the flow shown in FIG. 8 starts, at first, at the step S40, it is judged if the fuel-cut requirement flag Ffc is set (Ffc=1). When it is judged that Ffc=1, the flow proceeds to the step S41. On the other hand, when it is not judged that Ffc=1, the flow ends directly.

At the step S41, the minute-injection amount Qmin is set as the target injection amount Qt. Next, at the step S42, it is judged if the absolute value of the gravity position difference DGca is larger than or equal to the predetermined gravity position difference DGcath. When it is judged that the absolute value of the difference DGca is larger than or equal to the predetermined difference DGcath, the flow proceeds to the step S43. On the other hand, when it is not judged that the absolute value of the difference DGca is larger than or equal to the predetermined difference DGcath, the flow proceeds to the step S45.

At the step S43, it is judged if the absolute value of the heat release rate difference DdQg is larger than or equal to the predetermined heat release rate difference DdQgth. When it is judged that the absolute value of the difference DdQg is larger than or equal to the predetermined difference DdQgth, the flow proceeds to the step S44 where the gravity position and heat release rate correction coefficients Kca and Khr are calculated and thereafter, the flow proceeds to the step S45. On the other hand, when it is not judged that the absolute value of the difference DdQg is larger than or equal to the predetermined difference DdQgth, the flow proceeds to the step S45.

At the step S45, zero is set as the target injection amount Qt and thereafter, the flow ends.

The correction coefficient calculation control according to the third embodiment will be described. This control is carried out when the required load KLr is zero. When this control is carried out, the minute-injection amount Qmin is set as the target injection amount Qt. Thereby, the minute-injection amount Qmin of the fuel is injected from the fuel injector 20. Then, the present gravity position Gca and the present gravity point heat release rate dQg are calculated. Then, the gravity position and heat release rate differences DGca and DdQg are calculated.

When these differences DGca and DdQg are larger than or equal to the predetermined gravity position and heat release rate differences DGcath and DdQgth, respectively, the gravity position correction coefficient Kca for eliminating the gravity position difference DGca is calculated.

By the gravity position correction control according to the third embodiment, for the same reason as that described relating to the first embodiment, the exact gravity position Gca can be calculated. Further, for the same reason as that described relating to the second embodiment, the load of the ECU 70 due to the correction control can be decreased.

Further, even when both of the gravity position Gca and the gravity point heat release rate dQg have the differences, respectively, the correction of the gravity position calculation parameter to eliminate the gravity position difference DGca may be sufficient for calculating the exact gravity position Gca. In this case, by the correction control according to the third embodiment, the heat release rate correction coefficient Khr is not calculated and only the gravity position correction coefficient Kca is calculated. Thus, the load of the ECU 70 due to the correction control can be decreased.

Referring to FIG. 9, the correction coefficient calculation flow according to the third embodiment will be described. The steps S50 to S53 and S55 of the flow shown in FIG. 9 are the same as the steps S40 to S43 and S45 of the flow shown in FIG. 8, respectively and therefore, the description of these steps will be omitted.

At the step S54 of the flow shown in FIG. 9, the gravity position correction coefficient Kca is calculated and thereafter, the flow proceeds to the step S55.

The correction coefficient calculation control according to the fourth embodiment will be described. This control is carried out when the required load KLr is zero. When this control is carried out, the minute-injection amount Qmin is set as the target injection amount Qt. Thereby, the minute-injection amount Qmin of the fuel is injected from the fuel injector 20. Then, the present gravity position Gca and the present gravity point heat release rate dQg are calculated. Then, the gravity position and heat release rate differences DGca and DdQg are calculated.

When these differences DGca and DdQg are larger than or equal to the predetermined gravity position and heat release rate differences DGcath and DdQgth, respectively, the heat release rate correction coefficient Khr for eliminating the heat release rate difference DdQg is calculated.

By the gravity position correction control according to the fourth embodiment, for the same reason as that described relating to the first embodiment, the exact gravity position Gca can be calculated. Further, for the same reason as that described relating to the second embodiment, the load of the ECU 70 due to the correction control can be decreased.

In addition, even when both of the gravity position Gca and the gravity point heat release rate dQg have the differences, respectively, the correction of the gravity position calculation parameter to eliminate the heat release rate difference DdQg may be sufficient for calculating the exact gravity position Gca. In this case, by the correction control according to the fourth embodiment, the gravity position correction coefficient Kca is not calculated and only the heat release rate correction coefficient Khr is calculated. Thus, the load of the ECU 70 due to the correction control can be decreased.

Referring to FIG. 10, the correction coefficient calculation flow according to the fourth embodiment will be described. The steps S60 to S63 and S65 of the flow shown in FIG. 10 are the same as the steps S40 to S43 and S45 of the flow shown in FIG. 8, respectively and therefore, the descriptions of these steps will be omitted.

At the step S64 of the flow shown in FIG. 10, the heat release rate correction coefficient Khr is calculated and thereafter, the flow proceeds to the step S65.

The correction coefficient calculation control according to the fifth embodiment will be described. In the following description, an actual injection amount difference DQ is a difference of the actual injection amount Qa relative to the target injection amount Qt. The actual injection amount Qa is an amount of the fuel actually injected from the fuel injector 20. A minute-learning-injection amount Qmg is a fuel injection amount for generating an extremely small heat production. The heat production is a heat amount generated by the combustion of the fuel in the combustion chamber.

According to the fifth embodiment, the amount of the change of the heat production when the minute-learning-injection amount Qmg of the fuel is injected from the fuel injector 20 at a predetermined timing under the state that no actual injection amount difference DQ occurs, is previously obtained by an experiment or the like. Then, this change amount of the heat production is memorized in the ECU 70 as base change amount DQhpb.

The correction coefficient calculation control according to the fifth embodiment is carried out when the required load KLr is zero. When this control is carried out, at first, the minute learning is carried out. When this minute learning is carried out, the minute-learning-injection amount Qmg is set as the target injection amount Qt. Thereby, the minute-learning-injection amount Qmg of the fuel is injected from the fuel injector 20. Then, the change amount DQhp of the heat production is calculated. When the calculated change amount DQhp of the heat production does not correspond to the base change amount DQhpb, an injection correction coefficient Kinj for correcting the opening time period TAU of the fuel injector 20 (in particular, a time for supplying an electrical power to the fuel injector 20) such that the target injection amount Qt of the fuel is injected from the fuel injector 20, is calculated. Thereafter, the fuel injection is carried out after the opening time period TAU is corrected by the thus calculated injection correction coefficient Kinj.

Next, in the correction coefficient calculation control according to the fifth embodiment, the minute-injection amount Qmin is set as the target injection amount Qt. Thereby, the minute-injection amount Qmin of the fuel is injected from the fuel injector 20. Then, the present gravity position Gca and the present gravity point heat release rate dQg are calculated. Then, the gravity position and heat release rate differences DGca and DdQg are calculated.

When the gravity position difference DGca is larger than or equal to the predetermined gravity position difference DGcath, the gravity position correction coefficient Kca is calculated.

Further, when the heat release rate difference DdQg is larger than or equal to the predetermined heat release rate difference DdQgth, the heat release rate correction coefficient Khr is calculated.

According to the fifth embodiment, the calculation of the correction coefficient is carried out after the difference DQ of the actual injection amount Qa is corrected by the minute leaning.

In the minute learning, when the calculated change amount DQhp of the heat production is smaller than the base change amount DQhpb, the injection correction coefficient Kinj is calculated as a coefficient for correcting the time for supplying the electrical power to the fuel injector 20 such that the opening time TAU of the injector 20 is elongated.

When the change amount DQhp of the heat production is larger than the base change amount DQhpb, the injection correction coefficient Kinj is calculated as a coefficient for correcting the time for supplying the electrical power to the fuel injector 20 such that the opening time TAU of the fuel injector 20 is shortened.

Further, in place of the change amount DQhp of the heat production, the change amount DNE or DTQ of the engine speed NE or the torque TQ may be used. In this case, the minute-learning-injection amount Qmg is the fuel injection amount which generates an extremely small change of the engine speed NE or the torque TQ.

Referring to the FIG. 1, the correction coefficient calculation control according to the fifth embodiment will be described. As shown in FIG. 11, before the time T0, the required load KLr is not zero and therefore, the amount depending on the required load KLr (this amount is larger than zero) is set as the target injection amount Qt. In addition, the fuel-cut requirement and correction coefficient calculation flags Ffc and Fccc are being reset.

When the required load KLr becomes zero at the time T0, the fuel-cut requirement flag Ffc is set and zero is set as the target injection amount Qt.

Then, at the time T1, the correction coefficient calculation flag Fccc is set. Thereby, the calculation of the correction coefficient Kinj is carried out. At this time, the minute-learning-injection amount Qmg is set as the target injection amount Qt and thereby, the minute learning is carried out. At the time T3, the minute learning ends.

At the time T4, the minute-injection amount Qmin is set as the target injection amount Qt. Then, the calculation of the correction coefficient Kca and/or Khr is carried out until the correction coefficient calculation flag Fccc is reset at the time T5.

When the calculation of the correction coefficient Kca and/or Khr ends at the time T5, zero is set as the target injection amount Qt.

When the required load KLr becomes larger than zero at the time T5, the fuel-cut requirement flag Ffc is reset and the amount depending on the required load KLr (this amount is larger than zero) is set as the target injection amount Qt.

By the gravity position correction control according to the fifth embodiment, the minute learning is carried out before the calculation of the gravity position and heat release rate correction coefficients Kca and Khr. Therefore, these coefficients Kca and Khr are calculated under the state that the injection amount difference DQ is eliminated. Thus, the further exact gravity position Gca can be calculated.

Referring to FIG. 12, the correction coefficient calculation flow according to the fifth embodiment will be described. The steps S71 to S76 of the flow shown in FIG. 12 are the same as the steps S41 to S46 of the flow shown in FIG. 8, respectively and therefore, the description of these steps will be omitted.

When the flow shown in FIG. 12 starts, at first, at the step S70, it is judged if the fuel-cut requirement flag Ffc is set (Ffc=1). When it is judged that Ffc=1, the flow proceeds to the step S70A where the minute learning is carried out and thereafter, the flow proceeds to the step S71. On the other hand, when it is not judged that Ffc=1, the flow ends directly.

The minute learning of the step S70A is carried out according to the flow shown in FIG. 13. When the flow shown in FIG. 13 starts, at first, at the step S80, the minute-learning-injection amount Qmg is set as the target injection amount Qt. Next, at the step S81, it is judged if the change amount DNE of the engine speed NE is equal to a base change amount DNEb (DNE=DNEb). When it is judged that DNE=DNEb, the flow proceeds to the step S82. On the other hand, when it is not judged that DNE=DNEb, the flow proceeds to the step S83 where the injection correction coefficient Kinj is calculated and thereafter, the flow proceeds to the step S82.

At the step S83, when the change amount DNE of the engine speed NE is larger than the base change amount DNEb, it is estimated that a rich difference (that is, the injection amount difference DQ which makes the actual injection amount Qa larger than the target injection amount Qt) occurs in the fuel injector 20 and therefore, the injection correction coefficient Kinj for shortening the opening time TAU of the fuel injector 20 set depending on the target injection amount Qt is calculated.

On the other hand, when the change amount DNE is smaller than the base change amount DNEb, it is estimated that a lean difference (that is, the injection amount difference DQ which makes the actual injection amount Qa smaller than the target injection amount Qt) occurs in the fuel injector 20 and therefore, the injection correction coefficient Kinj for elongating the opening time TAU of the fuel injector 20 set depending on the target injection amount Qt is calculated.

At the step S82, zero is set as the target injection amount Qt and thereafter, the flow ends.

In the aforementioned embodiments, when the engine load KL is at least within a predetermined range, the target position Gcat is a constant crank angle position, independently of the engine load KL and/or the engine speed NE. However, in the aforementioned embodiments, the target position Gcat may be a crank angle position within a constant range which makes the fuel consumption increasing rate become a value around the minimum value, independently of the engine load KL and/or the engine speed NE. For example, in the aforementioned embodiments, a constant crank angle for minimizing the running cost of the engine 10 is set as the target position Gcat.

An internal combustion engine, which uses a combustion center position in the combustion control, is known. The combustion center position is a crank angle at the time when a half of the total heat production generated in one combustion stroke is generated. In this control which uses the combustion center position, for example, the fuel injection timing and/or the EGR rate Regr are/is controlled such that the combustion center position becomes a predetermined position.

Figure 14B:
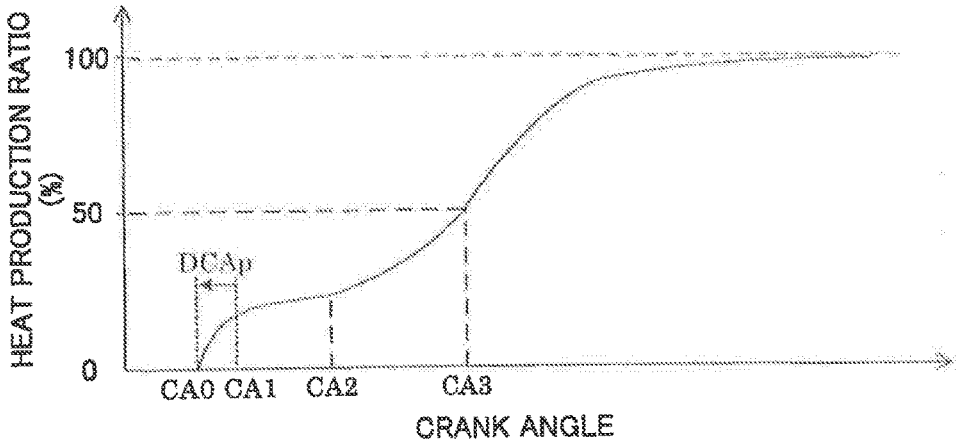

FIG. 14(A) shows a relationship between the crank angle CA and the heat production ratio when the pilot-injection timing is the crank angle CA1. FIG. 14(B) shows a relationship between the crank angle CA and the heat production ratio when the pilot-injection timing is the crank angle CA0. The heat production ratio is a ratio of the integration value of the heat production generated from the combustion start to each crank angle to the total heat production generated during one combustion stroke. The crank angle CA0 is on the advancing side of the crank angle CA1. The main- and after-injection timings in FIG. 14(A) are the same as those in FIG. 14(B).

From FIGS. 14(A) and (B), it can be understood that the pilot-injection timing in FIG. 14(B) is advanced by an angle Dqp from the pilot-injection timing in FIG. 14(A). However, the combustion center position is not changed from the crank angle CA3. Therefore, the combustion center position is not an index which exactly expresses the manner of the combustion in each engine cycle.

Figure 15A:
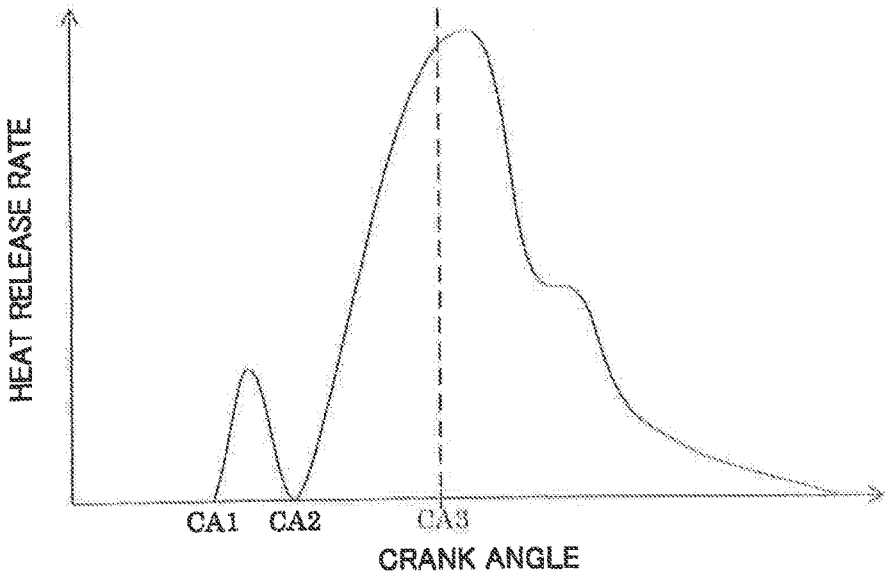
FIG. 15(A) shows a relationship between the crank angle and the heat release rate when the pilot-injection is carried out at the particular crank angle and FIG. 15(B) shows a relationship between the crank angle and the heat release rate when the pilot-injection is carried out at the crank angle advanced from the particular crank angle.
Figure 15B:
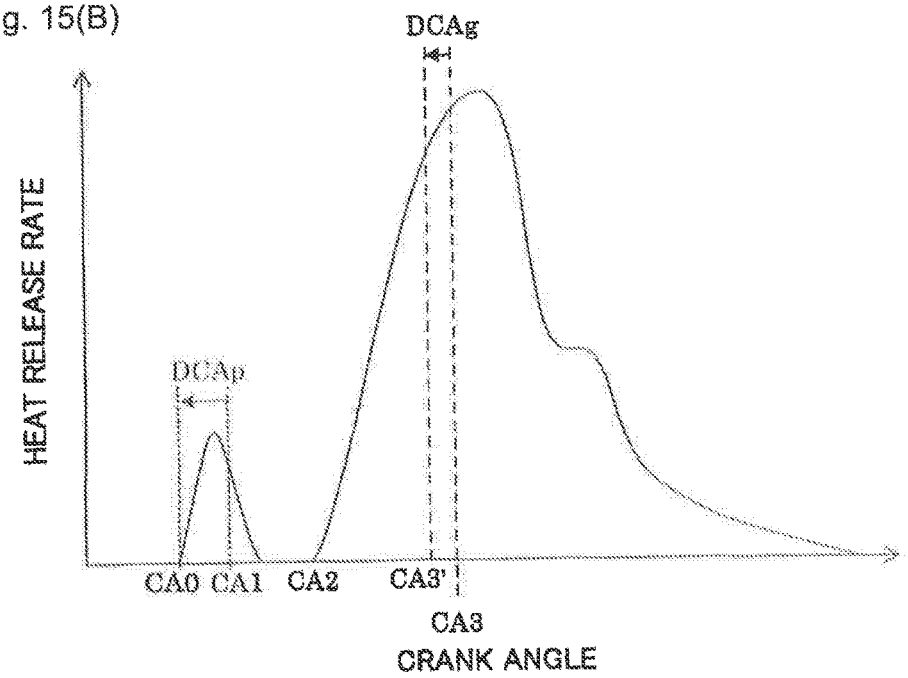

On the other hand, FIG. 15(A) shows a relationship between the crank angle CA and the heat release rate dQ(CA) when the pilot-, main- and after-injections are carried out at the same timings, respectively as those in FIG. 14(A). FIG. 15(B) shows a relationship between the crank angle CA and the heat release rate dQ(CA) when the pilot-, main- and after-injections are carried out at the same timings, respectively as those in FIG. 14(B). From FIGS. 15(A) and (B), it can be understood that when the pilot-injection timing in FIG. 15(B) is advanced by the angle DCAp relative to the pilot-injection timing in FIG. 15(A), the gravity position Gca in FIG. 15(B) is on the advancing side of the gravity position Gca in FIG. 15(A) by an angle DCAg. Therefore, the gravity position Gca is an index which exactly expresses the manner of the combustion in each engine cycle.

Figure 16A:
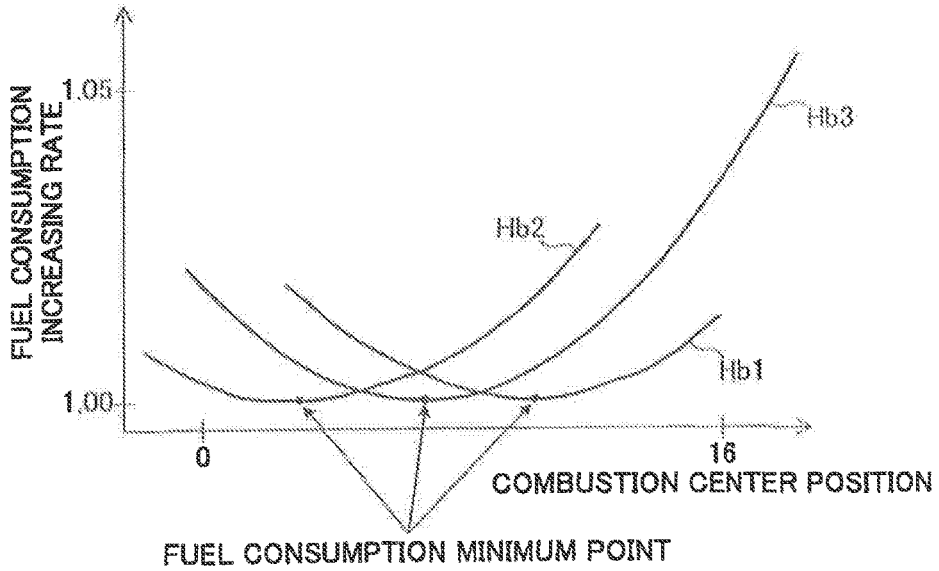
FIG. 16(A) shows a relationship between a combustion center position and a fuel consumption increasing rate and FIG. 16(B) shows a relationship between the heat release rate gravity position and the fuel consumption increasing rate.

FIG. 16(A) shows a relationship between the combustion center position and the fuel consumption increasing rate. In FIG. 16(A), the curve Hb1 shows the relationship when the engine load KL and the engine speed NE are small. The curve Hb2 shows the relationship when the engine load KL and the engine speed NE are middle. The curve Hb3 shows the relationship when the engine load KL and the engine speed NE are large.

Figure 16B:
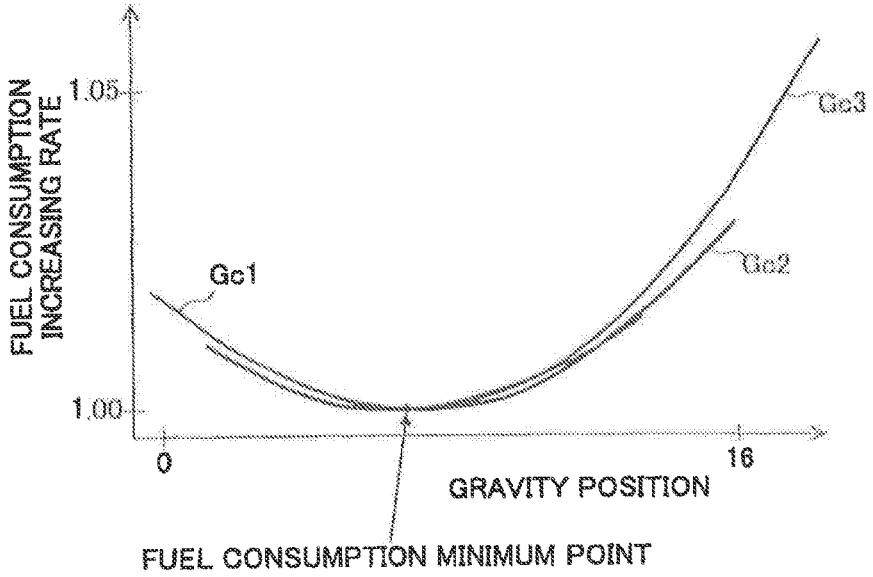

On the other hand, FIG. 16(B) shows a relationship between the gravity position Gca and the fuel consumption increasing rate. In FIG. 16.(B), the curve Gel shows the relationship when the engine load KL and the engine speed NE are small. The curve Gc2 shows the relationship when the engine load KL and the engine speed NE are middle. The curve Gc3 shows the relationship when the engine load KL and the engine speed NE are large.

As can be understood from FIG. 16(A), when the engine speed NE changes, the combustion center position which minimizes the fuel consumption increasing rate also changes. That is, even when the combustion state is controlled such that the combustion center position corresponds to a constant base value, the fuel consumption increasing rate does not become minimum if the engine speed NE changes.

On the other hand, as can be understood from FIG. 16(B), even when the engine speed NE changes, the gravity position Gca which minimizes the fuel consumption increasing rate is a constant crank angle (in particular, the crank angle 7 degrees after the compression top dead center ATDC). That is, if the combustion state is controlled such that the gravity position Gca corresponds to the constant crank angle (in particular, the crank angle 7 degrees ATDC), the fuel consumption increasing rate becomes minimum even if the engine speed NE changes. The gravity position control according to the aforementioned embodiments controls the gravity position Gca to the crank angle which minimizes the fuel consumption increasing rate (in particular, the crank angle 7 degrees ATDC) on the basis of the aforementioned knowledge.

When a frequency component of an engine sound (that is, a sound discharged from the engine 10) changes as the time elapses, the human tends to feel this sound uncomfortable. The frequency component of the engine sound has a correlation with the cylinder pressure change speed (that is, the change amount of the cylinder pressure Pc per unit time). Immediately after the main combustion (the combustion of the main-injection fuel) starts, the cylinder pressure Pc increases rapidly and therefore, the cylinder pressure change speed is maximum. Therefore, if the cylinder pressure change speed immediately after the main combustion starts, is constant between the engine cycles, the audibility of the engine sound increases.

On the other hand, the cylinder pressure change speed at an optional crank angle has a correlation with an inclination of the combustion waveform at this crank angle. Therefore, if the shapes of the combustion waveforms in the engine cycles are similar to each other, the cylinder pressure change speed immediately after the main combustion starts, is constant between the engine cycles and as a result, the audibility of the engine sound increases.

The curve S shown in FIG. 17 indicates the combustion waveform when the engine output is small. The curve L shown in FIG. 17 indicates the combustion waveform when the engine output is large. In either case, the heat release rate dQ increases to a peak value by the combustion of the pilot-injection fuel and thereafter, decreases to a minimum value and thereafter, increases again to a peak value by the combustion of the main-injection fuel.

The chain line IS shown in FIG. 17 indicates a tangential line of the combustion waveform S immediately after the main combustion starts when the engine output is small. The inclination of this tangential line IS corresponds to that of the combustion waveform S immediately after the main combustion starts (that is, the increasing rate of the heat release rate dQ).

On the other hand, the chain line IL shown in FIG. 17 indicates a tangential line of the combustion waveform L immediately after the main combustion starts when the engine output is large. The inclination of this tangential line IL corresponds to that of the combustion waveform L immediately after the main combustion starts (that is, the increasing rate of the heat release rate dQ).

When the required output increases and the combustion waveform changes from the combustion waveform S to the combustion waveform L, if the inclination IL of the combustion waveform L is equal to the inclination IS of the combustion waveform S, the audibility of the engine sound is better than the case that the inclination IL is not equal to the inclination IS.

In the aforementioned embodiments, when the value of the combustion control parameter is changed, the value of the combustion control parameter may be changed such that the increasing rate of the heat release rate dQ immediately after the main combustion starts in each engine cycle, becomes constant.

Figure 18A:
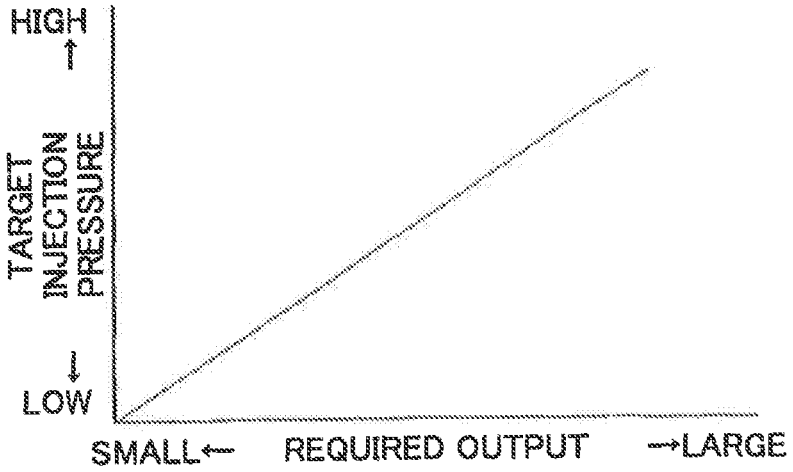
FIG. 18(A) shows a relationship between a required output and a target injection pressure and FIG. 18(B) shows a relationship between the required output and the target supercharging pressure.
Figure 18B:
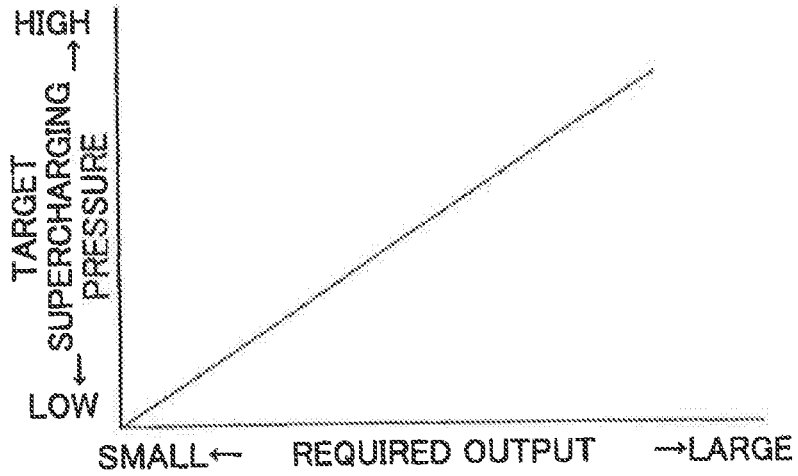

In particular, as shown in FIG. 18, when the required output is constant, the value of the combustion control parameter may be changed such that at least one of the injection pressure Pi and the supercharging pressure Pim is maintained constant, independently of the engine speed NE.

Otherwise, as shown in FIG. 18, the value of the combustion control parameter may be changed such that at least one of the injection pressure Pi and the supercharging pressure Pim is proportional to the required output. Thereby, the decreasing of the fuel consumption and the increasing of the audibility of the engine sound can be accomplished.

An example of the gravity position control will be described. In this example, the main- and pilot-injection timings which outputs the required output Pr from the engine 10 and makes the gravity position Gca correspond to the target position Gcat, are previously obtained by an experiment or the like every the required output Pr, the injection amount Q (or the pilot- and main-injection amounts Qp and Qm), the injection pressure Pi and the supercharging pressure Pim. These main- and pilot-injection timings are memorized in the ECU 70 in the form of a map (hereinafter, this map will be referred to as "injection timing map") as a function of the required output Pr, the injection amount Q (or the main and pilot-injection amounts Qp and Qm), the injection pressure Pi and the supercharging pressure Pim.

During the gravity position control, the injection amount Q necessary to output the required output Pr (hereinafter, this amount will be referred to as "target injection amount") is set. Then, the target pilot- and main-injection amounts Qpt and Qmt are set on the basis of the target injection amount Qt. The ratio of the target pilot-injection amount Qpt to the target injection amount Qt is, for example, determined on the basis of the cooling water temperature THW and the engine speed NE. Further, the target injection pressure Pit is set from FIG. 18(A) on the basis of the required output Pr and the target supercharging pressure Pimt is set from FIG. 18(B) on the basis of the required output Pr.

The target pilot- and main-injection timings CApt and CAmt are set from the injection timing map on the basis of the required output Pr, the target injection amount Qt (or the target pilot- and main-injection amounts Qpt and Qmt), the injection pressure Pit and the target supercharging pressure Pimt.

When the gravity position Gca is on the advancing side of the target position Gcat (or when the gravity position Gca is on the advancing side of the target position Gcat by a predetermined value), the set target pilot- and main-injection timings CApt and CAmt are retarded. The retarding amount may be a constant amount or an amount having a correlation with the difference amount of the gravity position Gca relative to the target position Gcat. The pilot- and main-injections are carried out at the retarded target pilot- and main-injection timings CApt and CAmt, respectively.

On the other hand, when the gravity position Gca is on the retarding side of the target position Gcat (or when the gravity position Gca is at the retarding side of the target position Gcat by a predetermined value), the set target pilot- and main-injection timings CApt and CAmt are advanced. The advancing amount may be a constant amount or an amount having a correlation with the difference amount of the gravity position Gca relative to the target position Gcat. The pilot- and main-injections are carried out at the advanced target pilot- and main-injection timings CApt and CAmt, respectively.

In this example, an upper limit of the injection amount Q may be set and the target injection amount Qt is limited to this upper limit. This upper limit is, for example, a smaller one of the upper limit of the injection amount which maintains the smoke production amount in the engine 10 smaller than or equal to a predetermined amount and the upper limit of the injection amount which maintains the torque TQ of the engine 10 smaller than or equal to a permission value relating to the driving system and the like of the vehicle.

The present invention can be applied to the case that the main- and after-injections are carried out without the pilot-injection being carried out or the case that the pilot- and main-injections are carried out without the after-injection being carried out or the case that the main-injection is carried out without the pilot- and after-injections being carried out.

The control apparatus described above comprises:

(1) a parameter acquisition part (ECU 70) for acquiring at least one operation state parameter (the cylinder pressure Pr and the crank angle CA) expressing an operation state of the engine 10;

(2) a gravity position calculation part (ECU 70 and the step S11 of FIG. 4) for calculating a heat release rate gravity position Gca on the basis of the engine state parameter;

(3) a part (ECU 70 and the step S31 of FIG. 7) for carrying out a minute-injection for injecting a minute amount Qmin of a fuel from a fuel injector 20 so as not to generate an engine torque TQ when a required load KLr of the engine is zero;

(4) a part (ECU 70) for previously memorizing at least one of:

(a) a base position Gcab corresponding to the heat release rate gravity position when the minute-injection is carried out under the state that the operation state parameter has no error, and (b) a base rate dQb or dQgb corresponding to the heat release rate dQ or dQg corresponding to one of the heat release rate gravity position Gca and a heat release rate gravity point G when the minute-injection is carried out under the state that the operation state parameter has no error;

(5) a correction coefficient calculation part (ECU 70, the steps S33 and S36 of FIG. 7, the step S44 of FIG. 8, the step S54 of FIG. 9, the step 64 of FIG. 10 and the steps S74 and S76 of FIG. 12) for calculating at least one of:

(c) a gravity position correction coefficient Kca for correcting a reference position corresponding to the heat release rate gravity position Gca calculated by the gravity position calculation part when the minute-injection is carried out such that the reference position corresponds to the base position, and (d) a heat release rate correction coefficient Khr for correcting a reference rate corresponding to the heat release rate corresponding to one of the heat release rate gravity position Gca calculated by the gravity position calculation part and the heat release rate gravity point G when the minute-injection is carried out such that the reference rate corresponds to the base rate; and (6) a part (ECU 70) for carrying out at least one of:

(e) a correction process for correcting the heat release rate gravity position Gca calculated by the gravity position calculation part by the gravity position correction coefficient Kca when the required load KLr is larger than zero, (f) a correction process for correcting the heat release rate gravity position Gca calculated by the gravity position calculation part by the heat release rate correction coefficient Khr when the required load KLr is larger than zero; and (7) a control part (ECU 70 and the steps S11 to S14 of FIG. 4) for controlling the corrected heat release rate gravity position to a target position by changing at least one combustion parameter for controlling a combustion state in a combustion chamber of the engine when the required load is larger than zero.

Further, the control apparatus described above further comprises:

(8) a part (ECU 70 and the step S80 of FIG. 13) for carrying out a learning-injection for injecting a small amount Qmg of the fuel from the fuel injector 20 so as to generate an extremely small engine torque TQ when the required load KLr is zero;

(9) a part (ECU 70) for previously memorizing a base amount corresponding to an amount of a change of an engine torque TQ when the learning-injection is carried out under the state that the amount of the fuel injected from the fuel injector has no error;

(10) a torque change amount acquisition part (ECU 70 and the step S81 of FIG. 13) for acquiring a torque change amount corresponding to the amount of the change of the engine torque;

(11) a part (ECU 70 and the step S83 of FIG. 13) for calculating a fuel injection amount correction coefficient Kinj for correcting the amount of the fuel injected from the fuel injector 20 such that the torque change amount acquired by the torque change amount acquisition part corresponds to the base amount when the learning-injection is carried out; and

(12) an injection amount correction part (ECU 70) for correcting the amount of the fuel injected from the fuel injector by the fuel injection amount correction coefficient Kinj when the required load KLr is larger than zero, wherein the correction coefficient calculation part calculates at least one of the gravity position correction coefficient Kca and the heat release rate correction coefficient Khr when the amount of the fuel is corrected by the injection amount correction coefficient Kinj.

The invention claimed is:

1. A control apparatus of an internal combustion engine provided with at least one combustion chamber and at least one fuel injector for injecting fuel to supply the fuel to said combustion chamber, wherein the control apparatus comprises an electronic control unit which memorizes:

a base position corresponding to a heat release rate gravity position to be acquired when a first injection for injecting a predetermined first amount of a fuel from said fuel injector is normally carried out; and a base rate corresponding to a heat release rate corresponding to one of said heat release rate gravity position and a heat release rate gravity point to be acquired when said first injection is normally carried out, said electronic control unit being configured:

to acquire any of a combination of a cylinder pressure and a crank angle, and an ion current generated due to combustion of the fuel used in determining the heat release rate expressing an operation state of said engine;

to calculate said heat release rate gravity position on the basis of the heat release rate;

to carry out said first injection when a required load of said engine is zero;

to calculate a gravity position correction coefficient for correcting a reference position corresponding to said heat release rate gravity position when said first injection is carried out such that said reference position corresponds to said base position;

to calculate a heat release rate correction coefficient for correcting a reference rate corresponding to said heat release rate when said first injection is carried out such that said reference rate corresponds to said base rate;

to carry out:

a correction process for correcting said heat release rate gravity position by said gravity position correction coefficient when said required load is larger than zero, and a correction process for correcting said heat release rate gravity position by said heat release rate correction coefficient when said required load is larger than zero; and to control said corrected heat release rate gravity position to a target position by changing at least one combustion parameter for controlling a combustion state in said combustion chamber of said engine when said required load is larger than zero.

2. The control apparatus of claim 1, wherein said electronic control unit memorizes a base amount corresponding to an amount of a change of an engine torque when a second injection for injecting a predetermined second amount of the fuel from said fuel injector is normally carried out, and said electronic control unit is configured:

to carry out said second injection when said required load is zero;

to acquire a torque change amount corresponding to the amount of the change of the engine torque;

to calculate a fuel injection amount correction coefficient for correcting the amount of the fuel injected from said fuel injector such that said torque change amount corresponds to said base amount when said second injection is carried out;

to correct the amount of the fuel injected from said fuel injector by said fuel injection amount correction coefficient when said required load is larger than zero; and to calculate said gravity position correction coefficient and said heat release rate correction coefficient when the amount of the fuel is corrected by said injection amount correction coefficient.

3. The control apparatus of claim 1, wherein the control apparatus includes a sensor for detecting a pressure in said combustion chamber as the cylinder pressure.

4. The control apparatus of claim 1, wherein the control apparatus includes a sensor for detecting the crank angle.

5. The control apparatus of claim 1, wherein said target position is constant, independently of at least one of said required load and an engine speed.

* * * * *